US011718433B2

(12) United States Patent
Ikeda et al.

(10) Patent No.: US 11,718,433 B2
(45) Date of Patent: Aug. 8, 2023

(54) BAG SUPPLY SYSTEM AND BAG SUPPLY METHOD

(71) Applicant: KABUSHIKI KAISHA YASKAWA DENKI, Kitakyushu (JP)

(72) Inventors: Atsuo Ikeda, Kitakyushu (JP); Tomohiro Kamishio, Kitakyushu (JP); Haruhiko Koike, Kitakyushu (JP)

(73) Assignee: KABUSHIKI KAISHA YASKAWA DENKI, Kitakyushu (JP)

( * ) Notice: Subject to any disclaimer, the term of this patent is extended or adjusted under 35 U.S.C. 154(b) by 4 days.

(21) Appl. No.: 17/392,148

(22) Filed: Aug. 2, 2021

(65) Prior Publication Data

US 2022/0041316 A1 Feb. 10, 2022

(30) Foreign Application Priority Data

Aug. 4, 2020 (JP) ..... 2020-132249

(51) Int. Cl.
*B65B 43/12* (2006.01)
*B65B 43/30* (2006.01)
*B65B 43/52* (2006.01)

(52) U.S. Cl.
CPC ..... *B65B 43/30* (2013.01); *B65B 43/12* (2013.01); *B65B 43/52* (2013.01)

(58) Field of Classification Search
USPC ..... 53/459
See application file for complete search history.

(56) References Cited

U.S. PATENT DOCUMENTS 5,142,846 A * 9/1992 Alameda ..... B65B 57/06 53/506
2018/0347754 A1* 12/2018 Miller ..... G01V 8/12
2019/0070820 A1* 3/2019 Noda ..... B31B 70/001
2019/0127100 A1* 5/2019 Matsumura ..... B31B 70/003

FOREIGN PATENT DOCUMENTS

JP 2013-035584 2/2013
JP 2019-043652 3/2019

OTHER PUBLICATIONS

Japanese Office Action for corresponding JP Application No. 2020-132249, dated Sep. 30, 2022 (w/ English machine translation).
Japanese Office Action for corresponding JP Application No. 2020-132249, dated Dec. 28, 2022 (w/ English machine translation).

* cited by examiner

*Primary Examiner* — Chinyere J Rushing-Tucker
(74) *Attorney, Agent, or Firm* — Mori & Ward, LLP

(57) ABSTRACT

A bag supply system supplies a packaging bag to a storing position where a sandwich is stored, the bag supply system which includes an opening forming device configured to form an opening at a bag opening of the packaging bag, and a bag opening device configured to grip each of a first side edge portion and a second side edge portion of the opening in an opening direction, the opening direction being a direction in which the opening is opened, and open the bag opening by widening the opening in the opening direction.

13 Claims, 24 Drawing Sheets

BAG SUPPLY SYSTEM AND BAG SUPPLY METHOD

CROSS REFERENCE TO RELATED APPLICATIONS

This application claims the benefit of priority to Japanese Patent Application Number 2020-132249 filed on Aug. 4, 2020. The entire contents of the above-identified application are hereby incorporated by reference.

TECHNICAL FIELD

One or more embodiments of the present disclosure relate to a bag supply system and a bag supply method.

BACKGROUND

JP 2019-043652 A describes a triangular sandwich packaging machine. The triangular sandwich packaging machine includes a pair of grips for gripping near the both sides of an opening of a triangular sandwich pack, a moving body that intermittently moves the pair of grips to a plurality of wrapping stations, and a spatula insertion mechanism for forming edges in the triangular sandwich pack gripped by the pair of grips to form an opening shape.

SUMMARY

In known technology, the opening shape of the bag opening may be unstable. This has led to a demand for further improvement in opening shape stabilization.

The disclosure has been made in light of such problems and is directed at providing a bag supply system and a bag supply method capable of supplying a packaging bag with a stable opening shape.

To solve the problem described above, according to an aspect of the disclosure, a bag supply system configured to supply a packaging bag includes:

an opening forming device configured to form an opening at a bag opening of the packaging bag; and a bag opening device configured to support each of a first side edge portion and a second side edge portion, of the opening formed, in a first direction, the first direction being a direction in which the opening is opened, and open the bag opening by widening the opening in the first direction.

Also, according to another aspect of the disclosure, a bag supply method for supplying a packaging bag includes:

forming an opening at a bag opening of the packaging bag; and supporting each of a first side edge portion and a second side edge portion, of the opening formed, in a first direction, the first direction being a direction in which the opening is opened, and opening the bag opening by widening the opening in the first direction.

According to the bag supply system and the like of the disclosure, a packaging bag with a stable opening shape can be supplied.

DESCRIPTION OF EMBODIMENTS

An embodiment will be described below with reference to the drawings. Note that the present embodiment described below is an example in which a sandwich packaging bag is supplied. However, the contents of the packaging bag are not limited to a sandwich, and the packaging bag supplied may be used to package various contents.

1. Overall Configuration of Bag Supply System

Figure 1:
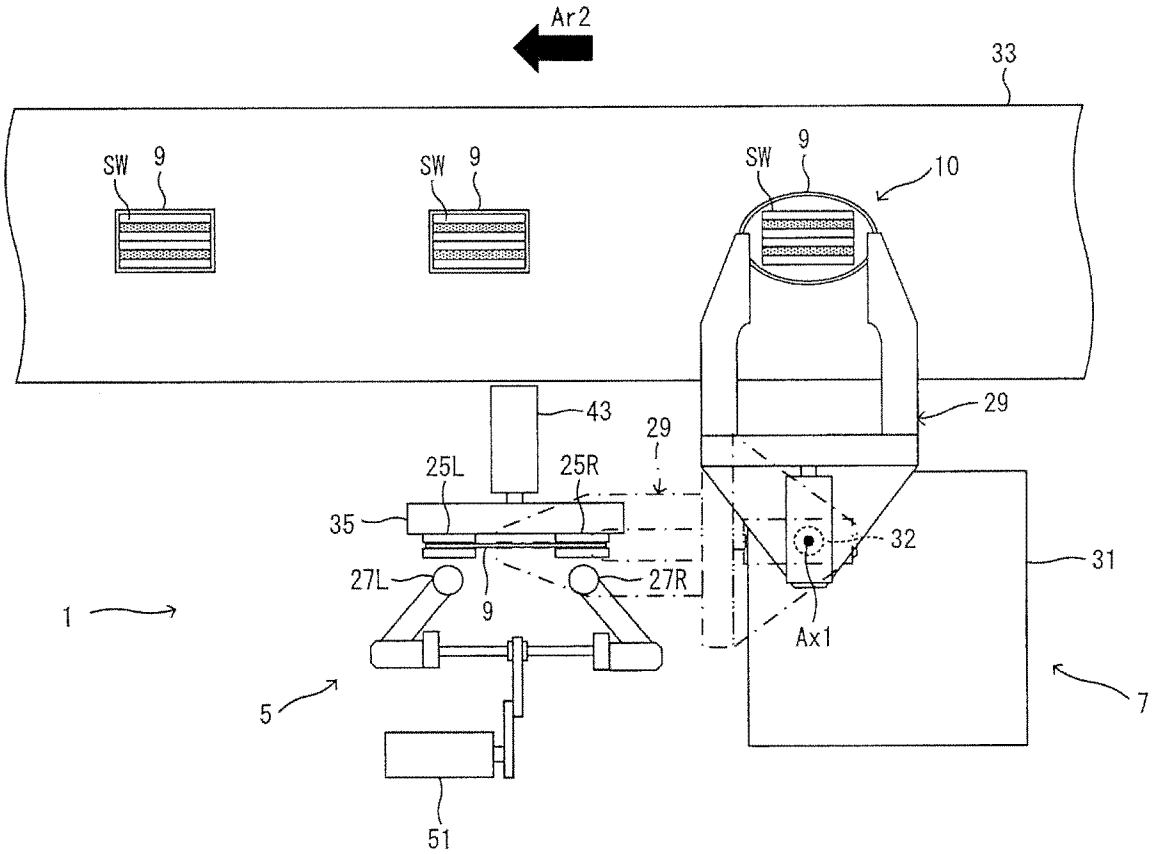
FIG. 1 is a top view illustrating an example of the overall configuration of a bag supply system.

First, an example of the overall configuration of a bag supply system according to the present embodiment will be described using FIGS. 1 and 2. FIG. 1 is a top view illustrating an example of the overall configuration of a bag supply system, and FIG. 2 is a side view illustrating an example of the configuration of a bag separating device.

Figure 2:
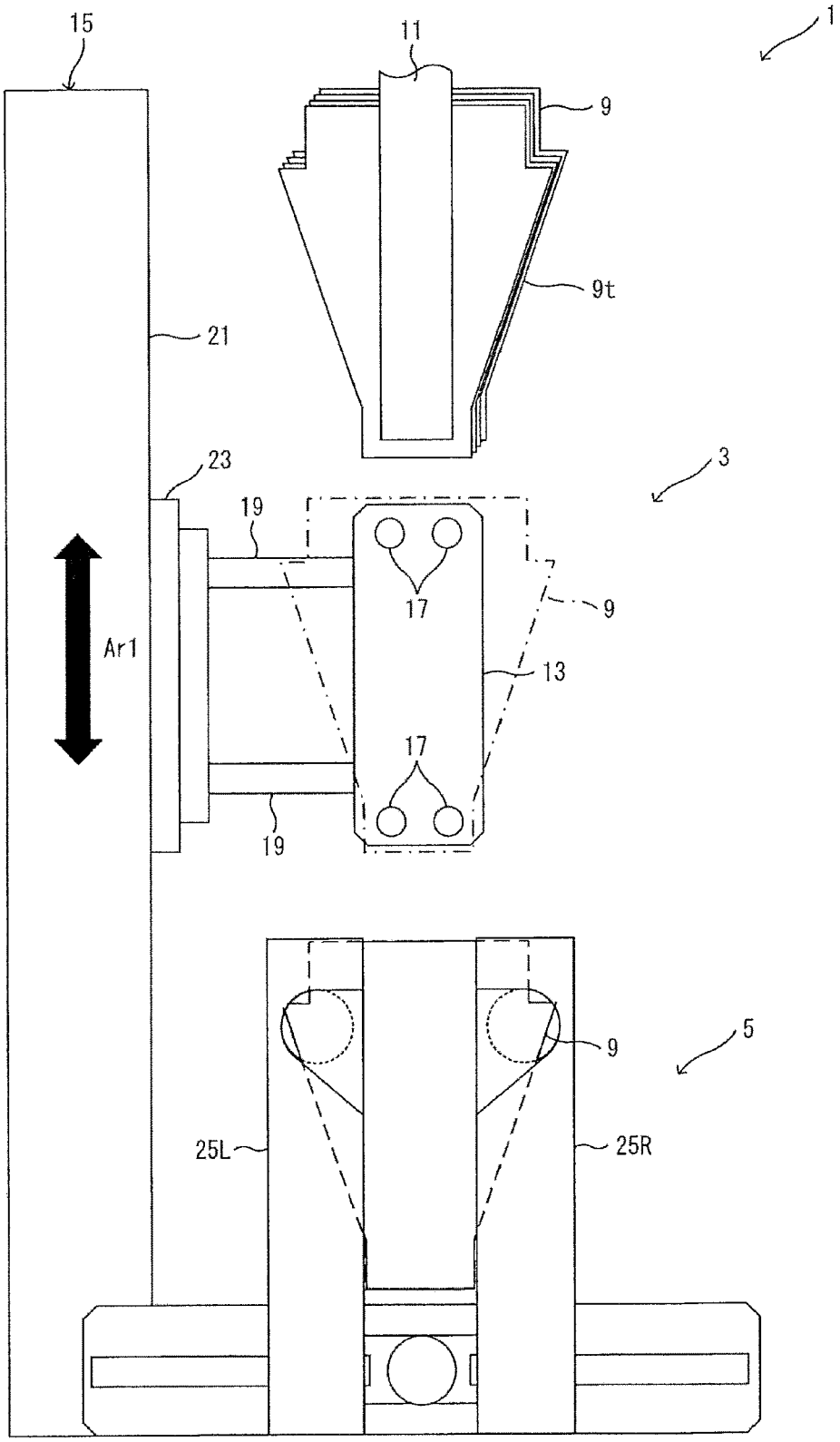
FIG. 2 is a side view illustrating an example of the configuration of a bag separating device.

As illustrated in FIGS. 1 and 2, a bag supply system 1 includes a bag separating device 3, an opening forming device 5, a bag opening device 7, and the like. The bag supply system 1 supplies a packaging bag 9 to a storing position 10 (an example of a supply destination) where a sandwich SW (an example of contents) is stored. Note that to alleviate complexity, the bag separating device 3 is not illustrated in FIG. 1 and the bag opening device 7 is not illustrated in FIG. 2.

As illustrated in FIG. 2, the bag separating device 3 includes a bag holder 11, a suction device 13, an actuator 15, and the like. The bag holder 11 holds a plurality of the packaging bags 9 stacked together. The packaging bag 9 includes a bag opening for inserting and taking out the sandwich SW and has a three-dimensional shape corresponding to the sandwich SW. The packaging bags 9 are stacked in a flattened state. The suction device 13 includes a plurality (for example, four) of suction pads 17 and holds the packaging bag 9 via suction. The suction device 13 is moved in the up-and-down direction by the actuator 15 via support members 19. The actuator 15 includes a rotary motor (not illustrated), a ball screw (not illustrated), a guide rail 21, a slider 23, and the like. The rotational motion of the rotary motor is converted to linear motion by the ball screw, and the slider 23 is moved in the up-and-down direction (indicated by double arrow Ar1) along the guide rail 21. Note that a linear motor may be used instead of a rotary motor, for example. According to the configuration described above, the bag separating device 3 repeatedly performs the operation of: separating via suction one packaging bag 9 at a time from among the stacked packaging bags 9, conveying the packaging bag 9 downward, releasing suction, and setting the packaging bag 9 in holding plates 25L, 25R of the opening forming device 5.

As illustrated in FIG. 1, the opening forming device 5 includes two rollers 27L, 27R. The packaging bag 9 set in the holding plates 25L, 25R is in a flattened state, and the bag opening is closed. The opening forming device 5 forms an opening at the bag opening using the rollers 27L, 27R. The configuration and operation of the opening forming device 5 will be described below.

The bag opening device 7 includes a hand 29, a moving device 31, and the like. The hand 29 grips (an example of support) edge portions of the opening of the packaging bag 9 formed by the opening forming device 5 and widens the opening while swiveling to open the bag opening. The configuration and operation of the hand 29 will be described below. The moving device 31 (an example of a moving device) includes a support member 32 that supports the hand 29, an actuator 117 (described below with reference to FIG. 15) that swivels the hand 29 about the support member 32 and moves the hand 29 vertically, and the like. The moving device 31 moves the packaging bag 9 from the opening forming device 5 to the storing position 10 by swiveling the hand 29 about a rotation axis Ax1 substantially parallel with the up-and-down direction. In addition, the moving device 31 moves the hand 29 in the up-and-down direction. The storing position 10 is located, for example, above a conveyor 33, and the packaging bag 9 storing the sandwich SW is placed on the conveyor 33 and conveyed downstream in the conveyance direction (indicated by arrow Ar2).

2. Configuration and Operation of Opening Forming Device

Figure 3:
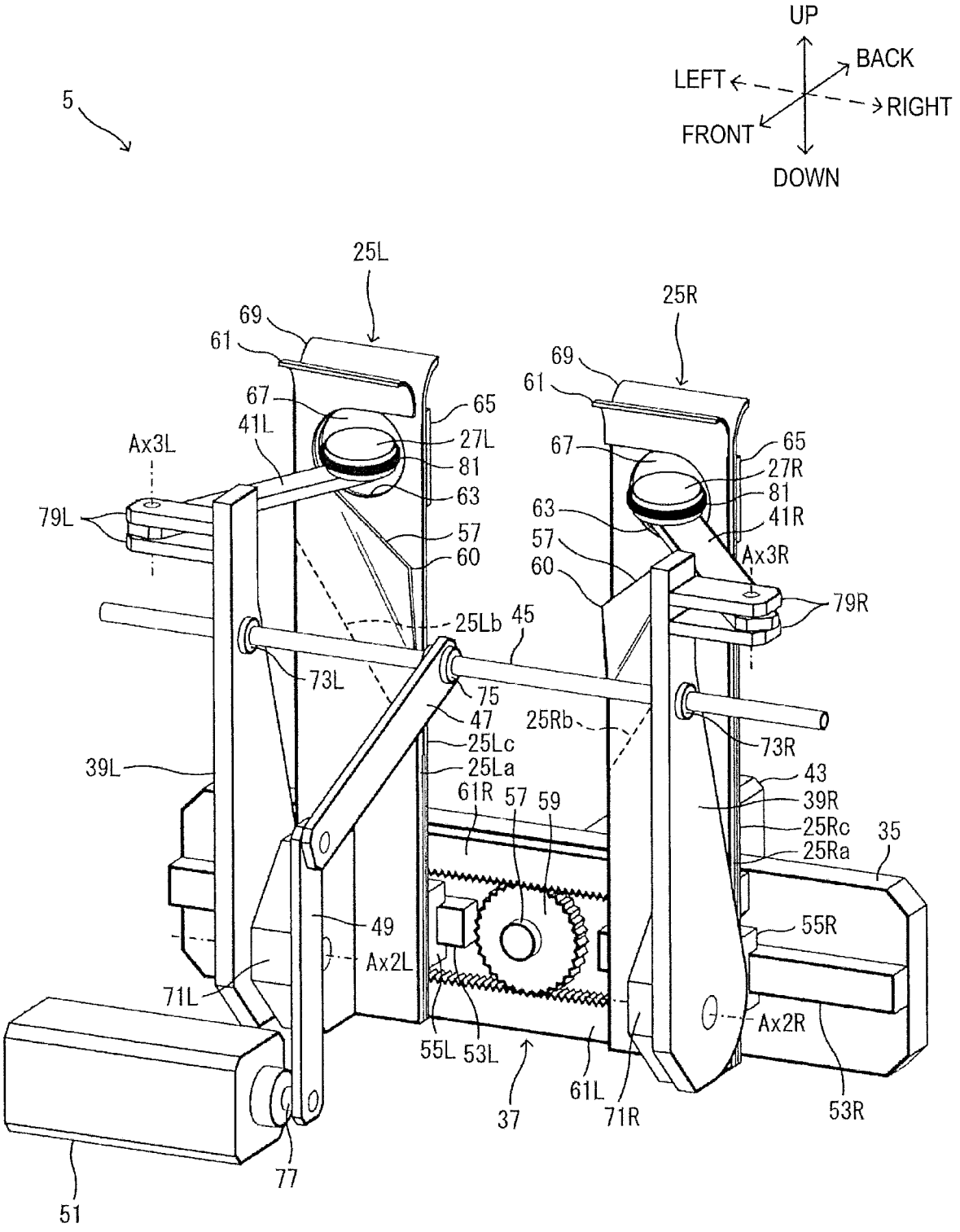
FIG. 3 is a perspective view illustrating an example of the configuration of an opening forming device.
Figure 4:
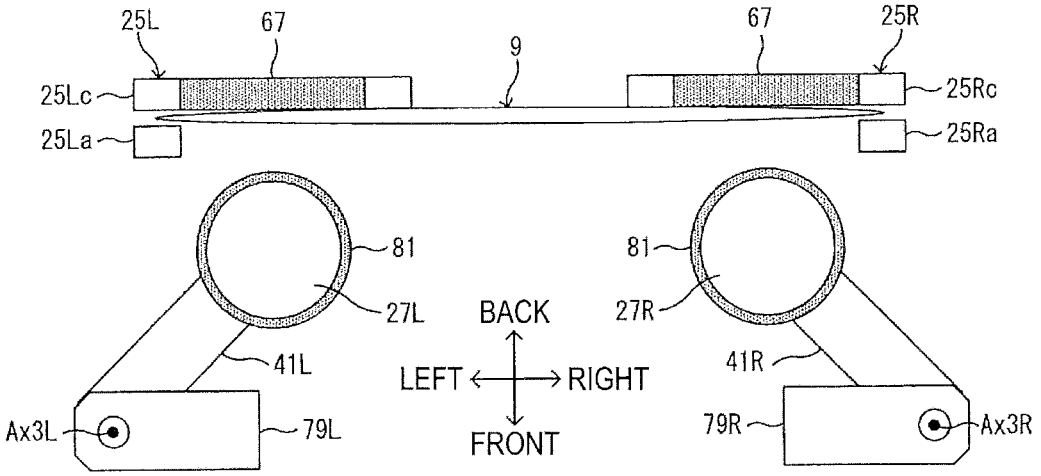
FIG. 4 is an explanatory diagram illustrating an example of the opening foiling operation by the opening forming device.
Figure 5:
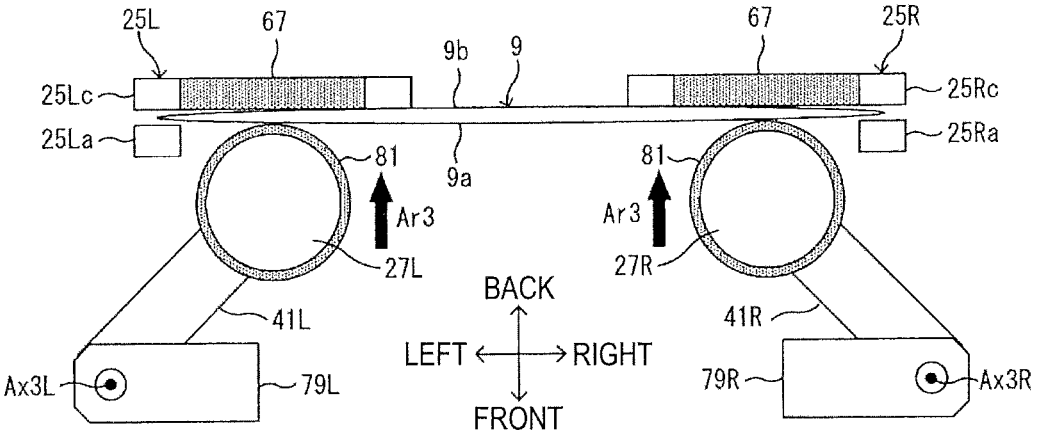
FIG. 5 is an explanatory diagram illustrating an example of the opening forming operation by the opening forming device.
Figure 6:
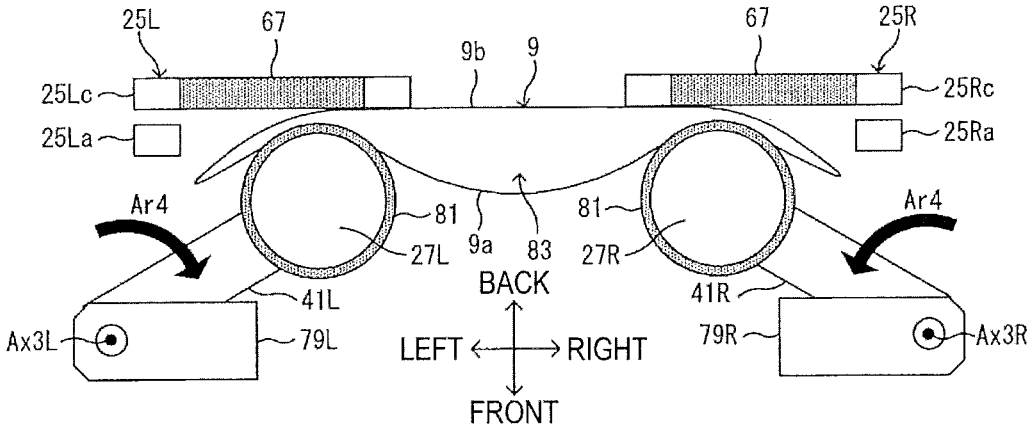
FIG. 6 is an explanatory diagram illustrating an example of the opening forming operation by the opening forming device.

Next, an example of the configuration and operation of the opening forming device 5 will be described using FIGS. 3 to 6. FIG. 3 is a perspective view illustrating an example of the configuration of the opening forming device 5, and FIGS. 4 to 6 are explanatory diagrams illustrating an example of the opening forming operation by the opening forming device 5. Note that hereinafter, directions such as up, down, left, right, front, and back will be used as appropriate for convenience in describing the configuration of the opening forming device 5 and the like. However, the positional relationship between the components of the opening forming device 5 and the like are not limited thereto. Furthermore, portions not required for the description are omitted as appropriate in FIGS. 4 to 6.

As illustrated in FIG. 3, the opening forming device 5 includes a base 35, a rack and pinion mechanism 37, the holding plates 25L, 25R, arms 39L, 39R, links 41L, 41R, the rollers 27L, 27R, a motor 43, a support shaft 45, links 47, 49, a motor 51, and the like.

The base 35 is a substantially rectangular plate-like member. Hereinafter, for convenience of explanation, the configuration of the opening forming device 5 will be described with the length direction of the base 35 corresponding to the left-and-right direction, the width direction corresponding to the up-and-down direction, and the thickness direction corresponding to the front-and-back direction.

The rotary-type motor 43 is disposed at the back of the base 35 with its axial direction orientated to be substantially parallel with the front-and-back direction. The rack and pinion mechanism 37 is disposed on the front side of the base 35. The rack and pinion mechanism 37 includes a pinion 59 connected to an output shaft 57 of the motor 43, a rack 61L connected to the holding plate 25L and engaged with the pinion 59, a rack 61R connected to the holding plate 25R and engaged with the pinion 59, and the like. The pinion 59 is disposed in a substantially central portion of the front surface of the base 35, and the racks 61L, 61R are respectively disposed on the lower and upper sides of the pinion 59 in a manner allowing them to move in the left-and-right direction.

Also, guide rails 53L, 53R and sliders 55L, 55R are disposed on the front side of the base 35. The slider 55L is connected to the lower portion of the holding plate 25L and is movable in the left-and-right direction along the guide rail 53L. The slider 55R is connected to the lower portion of the holding plate 25R and is movable in the left-and-right direction along the guide rail 53R. According to the configuration described above, when the motor 43 (an example of a second actuator) is rotationally driven, the holding plates 25L, 25R move toward or away from one another, opening or closing in the left-and-right direction.

The holding plates 25L, 25R are each a plate-like member with a substantially rectangular shape and are erected with their length direction substantially parallel with the up-and-down direction. The holding plates 25L, 25R receive the packaging bag 9 conveyed by the bag separating device 3 from above and hold the packaging bag 9.

The holding plate 25L (an example of a first holding member) holds the left end side (an example of a side in a second direction) of the packaging bag 9. The holding plate 25L includes a front plate 25La, an intermediate plate 25Lb, and a back plate 25Lc, and these three plate members are formed together as a multilayered structure. The front plate 25La is a thin plate member having a substantially rectangular shape and includes a cutout 57 formed in the upper portion with a shape that corresponds to the circular shape of a friction member 67, described below, and opens toward the right side (the side where the holding plate 25R is located). The cutout 57 has a shape that allows the roller 27L to come into contact with the packaging bag 9 from the front and move in the right direction. A corner portion 60 on the lower side of the cutout 57 is bent slightly forward such that the gap between it and the back plate 25Lc is wider towards the tip of the corner portion 60. This enables an opening of the packaging bag 9 to be smoothly formed. An upper end portion 61 of the front plate 25La is curved in an arc shape toward the front. Furthermore, the upper end portion 61 is provided with a slight incline with respect to the left-and-right direction so that the gap between the upper end portion 61 and the back plate 25Lc is wider toward the right side (the side where the holding plate 25R is located). This enables an opening of the packaging bag 9 to be smoothly formed.

The intermediate plate 25Lb is a thin plate member sandwiched between the front plate 25La and the back plate 25Lc. An upper end portion of the intermediate plate 25Lb has a tapered shape that is inclined with respect to the up-and-down direction (indicated by the dashed line in FIG. 3). Accordingly, a gap corresponding to the shape of the packaging bag 9 is formed between the front plate 25La and the back plate 25Lc where the packaging bag 9 can be received and held.

The back plate 25Lc is a thin plate member having a substantially rectangular shape and includes a circular opening 63 formed in an upper portion thereof. The friction member 67 with a circular shape is provided inside the opening 63 via an attachment member 65 provided on the back side of the back plate 25Lc. The front surface of the friction member 67 and the front surface of the back plate 25Lc are substantially flush with one another. The friction member 67 (an example of a second friction member) is made from a material such as rubber, for example, and is brought into contact with an edge portion of the back side of the held packaging bag 9 and generates friction between itself and the edge portion. An upper end portion 69 of the back plate 25Lc is curved in an arc shape toward the back and, together with the upper end portion 61 of the front plate 25La, forms the receiving opening of the packaging bag 9. This allows the packaging bag 9 inserted from above to be smoothly received.

The holding plate 25R (an example of a second holding member) holds the right end side (an example of a side in a second direction) of the packaging bag 9. The holding plate 25R has the same structure as the holding plate 25L, but has a shape that is symmetrical in the left-and-right direction. In other words, the holding plate 25R includes a front plate 25Ra, an intermediate plate 25Rb, and a back plate 25Rc, and these three plate members are formed together as a multilayered structure. The front plate 25Ra is a thin plate member having a substantially rectangular shape and includes a cutout 57 formed in the upper portion with a shape that corresponds to the circular shape of a friction member 67 and opens toward the left side (the side where the holding plate 25L is located). The cutout 57 has a shape that allows the roller 27R to come into contact with the packaging bag 9 from the front and move in the left direction. A corner portion 60 on the lower side of the cutout 57 is bent slightly forward such that the gap between it and the back plate 25Rc is wider towards the tip of the corner portion 60. This enables an opening of the packaging bag 9 to be smoothly formed. An upper end portion 61 of the front plate 25Ra is curved in an arc shape toward the front. Furthermore, the upper end portion 61 is provided with a slight incline with respect to the left-and-right direction so that the gap between the upper end portion 61 and the back plate 25Rc is wider toward the left side (the side where the holding plate 25L is located). This enables an opening of the packaging bag 9 to be smoothly formed.

The intermediate plate 25Rb is a thin plate member sandwiched between the front plate 25Ra and the back plate 25Rc. An upper end portion of the intermediate plate 25Rb has a tapered shape that is inclined with respect to the up-and-down direction (indicated by the dashed line in FIG. 3). Accordingly, a gap corresponding to the shape of the packaging bag 9 is formed between the front plate 25Ra and the back plate 25Rc where the packaging bag 9 can be received and held.

The back plate 25Rc is a thin plate member having a substantially rectangular shape and includes a circular opening 63 formed in an upper portion thereof. The friction member 67 with a circular shape is provided inside the opening 63 via an attachment member 65 provided on the back side of the back plate 25Rc. The front surface of the friction member 67 and the front surface of the back plate 25Rc are substantially flush with one another. The friction member 67 (an example of a second friction member) is made from a material such as rubber, for example, and is brought into contact with an edge portion of the back side of the held packaging bag 9 and generates friction between itself and the edge portion. An upper end portion 69 of the back plate 25Rc is curved in an arc shape toward the back and, together with the upper end portion 61 of the front plate 25Ra, forms the receiving opening of the packaging bag 9. This allows the packaging bag 9 inserted from above to be smoothly received.

The arms 39L, 39R are respectively supported by arm brackets 71L, 71R provided on the front side of the lower end portion of the holding plates 25L, 25R in a manner allowing for rotation about rotation axes Ax2L, Ax2R. Bushings 73L, 73R are provided in the intermediate portion in the length direction of the arms 39L, 39R. The bushings 73L, 73R rotatably support the support shaft 45 extending substantially parallel with the left-and-right direction. The support shaft 45 is formed with a length longer than the interval between the arms 39L, 39R when the holding plates 25L, 25R are fully opened and is installed extending through the bushings 73L, 73R. A first end portion of the link 47 is rotatably connected to the support shaft 45 at a substantially intermediate position in the length direction via a bushing 75. A first end portion of the link 49 is rotatably connected to a second end portion of the link 47, and an output shaft 77 of the motor 51 is connected to a second end portion of the link 49. In this manner, when the motor 51 (an example of a first actuator) is rotationally driven, the arms 39L, 39R rotate about the rotation axes Ax2L, Ax2R, moving the upper end portions of the arms 39L, 39R toward and away from the holding plates 25L, 25R.

A link bracket 79L is provided at or near the upper end portion of the arm 39L protruding toward the left side. A first end portion of the link 41L is connected to an end portion of the link bracket 79L in a manner allowing for rotation about a rotation axis Ax3L. The roller 27L is provided on a second end portion of the link 41L at a position corresponding to the friction member 67 of the holding plate 25L. The roller 27L is fixed to the second end portion of the link 41L in a manner not allowing for rotation and swings about the rotation axis Ax3L together with the link 41L. The roller 27L is a disc-shaped member, and a friction member 81 is provided on an outer circumferential portion thereof. The friction member 81 (an example of a first friction member) is made from a material such as rubber, for example, and is brought into contact with an edge portion of the front side of the packaging bag 9 held by the holding plate 25L and generates friction between itself and the edge portion. A biasing member (for example, a coil spring) and a stopper, both not illustrated, are provided at the connecting portion between the link bracket 79L and the link 41L. The link 41L is biased in the counterclockwise direction (as seen from above) about the rotation axis Ax3L and is held at a position where it forms a predetermined angle with the link bracket 79L. In this manner, when the distance in the front-and-back direction between the upper end portion of the arm 39L and the holding plate 25L is greater than a predetermined distance, the friction member 81 of the roller 27L separates from the friction member 67. On the other hand, when the distance between the upper end portion of the arm 39L and the holding plate 25L is equal to or less than the predetermined distance, the friction member 81 of the roller 27L is pressed against the friction member 67 of the holding plate 25L with a predetermined force. Furthermore, when the upper end portion of the arm 39L is brought even closer to the holding plate 25L, the link 41L swings, moving the roller 27L in the right direction sliding against the friction member 67.

In a similar manner, a link bracket 79R is provided at or near the upper end portion of the arm 39R protruding toward the right side. A first end portion of the link 41R is connected to an end portion of the link bracket 79R in a manner allowing for rotation about a rotation axis Ax3R. The roller 27R is provided on a second end portion of the link 41R at a position corresponding to the friction member 67 of the holding plate 25R. The roller 27R is fixed to the second end portion of the link 41R in a manner not allowing for rotation and swings about the rotation axis Ax3R together with the link 41R. The roller 27R is a disc-shaped member, and a friction member 81 is provided on an outer circumferential portion thereof. The friction member 81 (an example of a first friction member) is made from a material such as rubber, for example, and is brought into contact with an edge portion of the front side of the packaging bag 9 held by the holding plate 25R and generates friction between itself and the edge portion. A biasing member (for example, a coil spring) and a stopper, both not illustrated, are provided at the connecting portion between the link bracket 79R and the link 41R. The link 41R is biased in the clockwise direction (as seen from above) about the rotation axis Ax3R and is held at a position where it forms a predetermined angle with the link bracket 79R. In this manner, when the distance in the front-and-back direction between the upper end portion of the arm 39R and the holding plate 25R is greater than a predetermined distance, the friction member 81 of the roller 27R separates from the friction member 67. On the other hand, when the distance between the upper end portion of the arm 39R and the holding plate 25R is equal to or less than the predetermined distance, the friction member 81 of the roller 27R is pressed against the friction member 67 of the holding plate 25R with a predetermined force. Furthermore, when the upper end portion of the arm 39R is brought even closer to the holding plate 25R, the link 41R swings, moving the roller 27R in the left direction sliding against the friction member 67.

According to the configuration described above, the opening forming device 5 slides, relative to the back edge portion, the front edge portion of the bag opening of the packaging bag 9 in the right direction (an example of a second direction) at the holding plate 25L and in the left direction (an example of a second direction) at the holding plate 25R. This forms an opening at the bag opening of the packaging bag 9.

Next, the opening forming operation will be described using FIGS. 4 to 6. When the distance between the upper end portion of the arms 39L, 39R and the holding plates 25L, 25R is greater than a predetermined distance, the friction member 81 of the rollers 27L, 27R is separated from the friction member 67 of the holding plates 25L, 25R, as illustrated in FIG. 4. In this state, the packaging bag 9 is inserted into the holding plates 25L, 25R.

Next, when the arms 39L, 39R are rotated toward the holding plates 25L, 25R by the rotational drive of the motor 51, as illustrated in FIG. 5, the rollers 27L, 27R move backward (indicated by arrow Ar3) and the friction member 81 of the rollers 27L, 27R comes into contact with the friction member 67 of the holding plates 25L, 25R, sandwiching the packaging bag 9. In this manner, the friction member 81 of the rollers 27L, 27R comes into contact with a front edge portion 9*a* (an example of a first side edge portion) of the packaging bag 9, and the friction member 67 of the holding plates 25L, 25R comes into contact with a back edge portion 9*b* (an example of a second side edge portion) of the packaging bag 9.

When the arms 39L, 39R are further rotated toward the holding plates 25L, 25R by the rotational drive of the motor 51, as illustrated in FIG. 6, the links 41L, 41R swing about the rotation axis Ax3L, Ax3R in the direction of arrow Ar4. Accordingly, the roller 27L moves in the right direction while pressed against the friction member 67 of the holding plate 25L with a predetermined force, and the roller 27R moves in the left direction while pressed against the friction member 67 of the holding plate 25R with a predetermined force. In other words, at the holding plates 25L, 25R, the friction members 81 move with respect to the friction members 67 relatively in opposite directions in the left-and-right direction. In this manner, the front edge portion 9*a* of the bag opening of the packaging bag 9 slides, relative to the back edge portion 9*b*, from the left and right sides toward a central region forming a bulge, this bulge corresponding to an opening 83 formed from the bag opening of the packaging bag 9.

This allows the hand 29 of the bag opening device 7 to support each of the front edge portion 9*a* and the back edge portion 9*b* of the formed opening 83 in the opening direction (an example of a first direction), i.e., the direction in which the opening 83 opens, and widen and open the opening 83 in the front-and-back direction.

Note that the links 41L, 41R and the links 47, 49 described above correspond to an example of a link mechanism configured to press a first friction member against a second friction member in a first direction and move the first friction member relative to the second friction member in a second direction with rotation of the motor.

3. Configuration and Operation of Hand of Bag Opening Device

Figure 7:
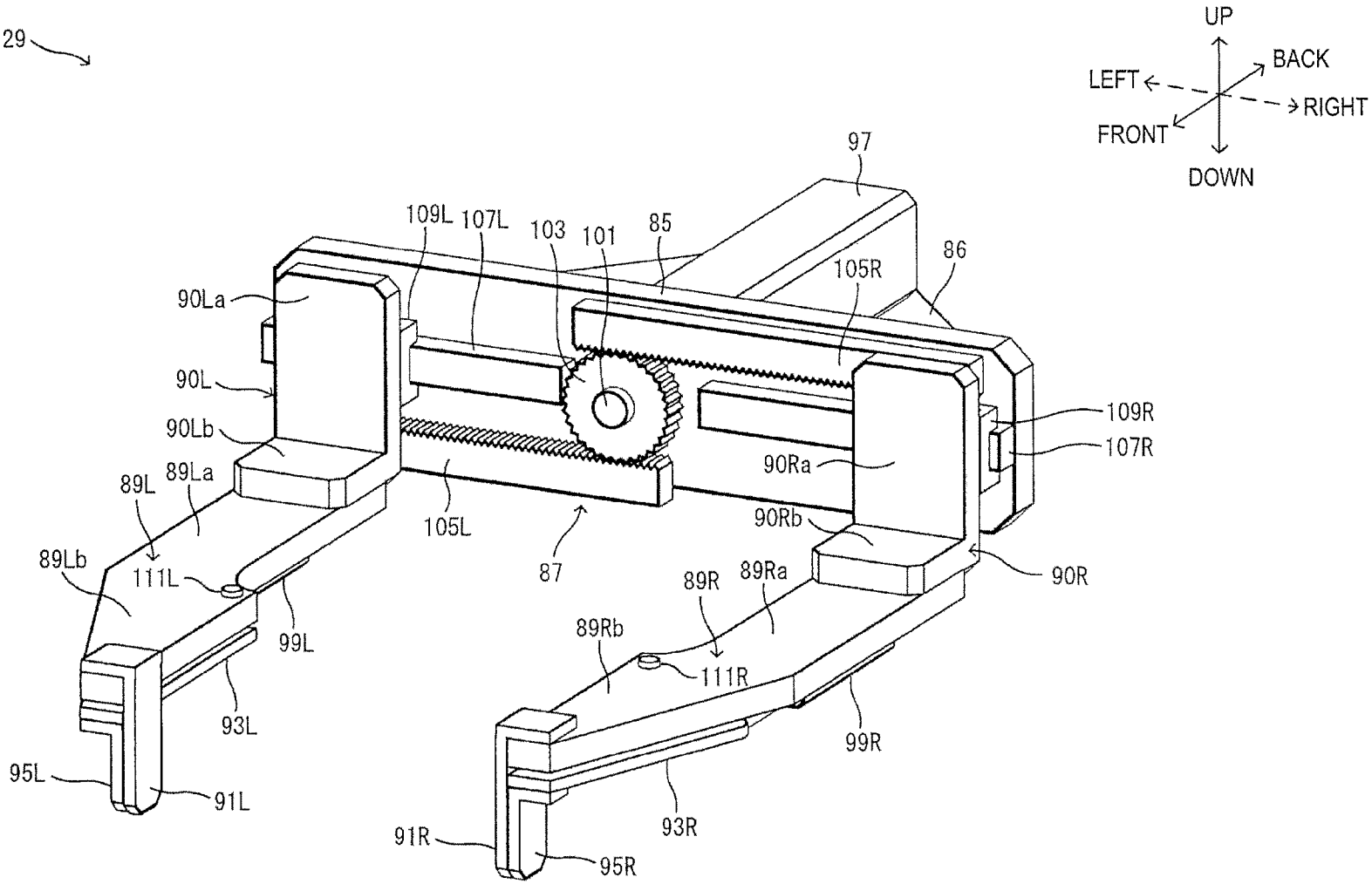
FIG. 7 is a perspective view illustrating an example of the configuration of a bag opening device in a state with claws of a hand closed.
Figure 8:
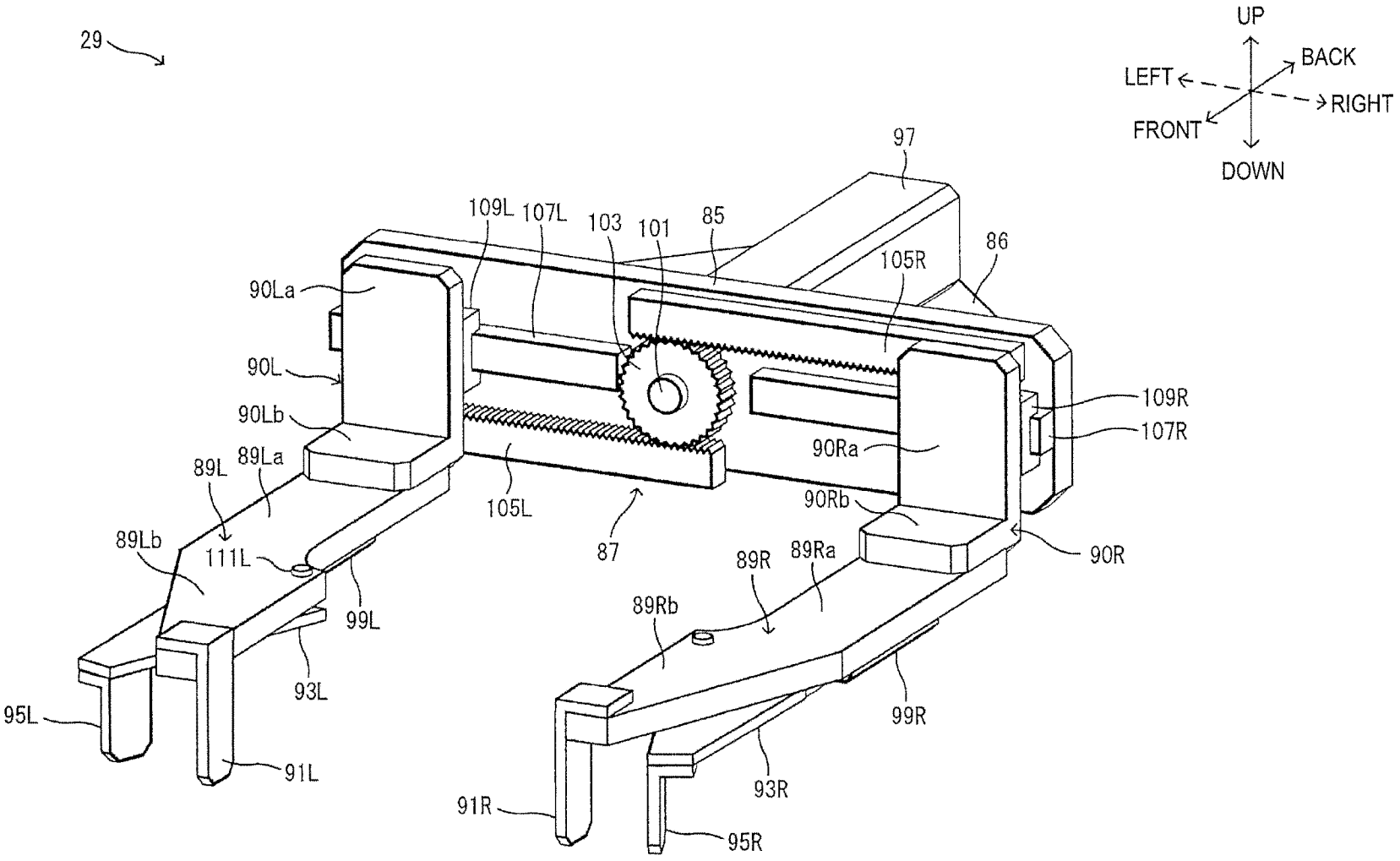
FIG. 8 is a perspective view illustrating an example of the configuration of the bag opening device in a state with the claws of the hand open.
Figure 9:
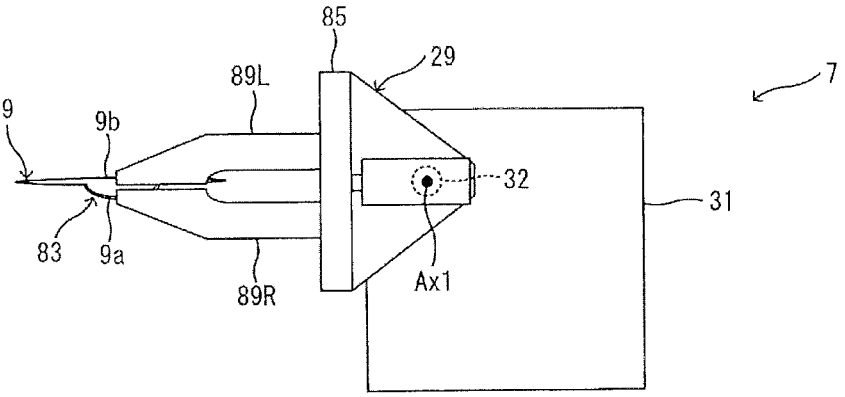
FIG. 9 is an explanatory diagram illustrating an example of the operation of opening the bag opening and moving a packaging bag executed by the hand of the bag opening device.
Figure 10:
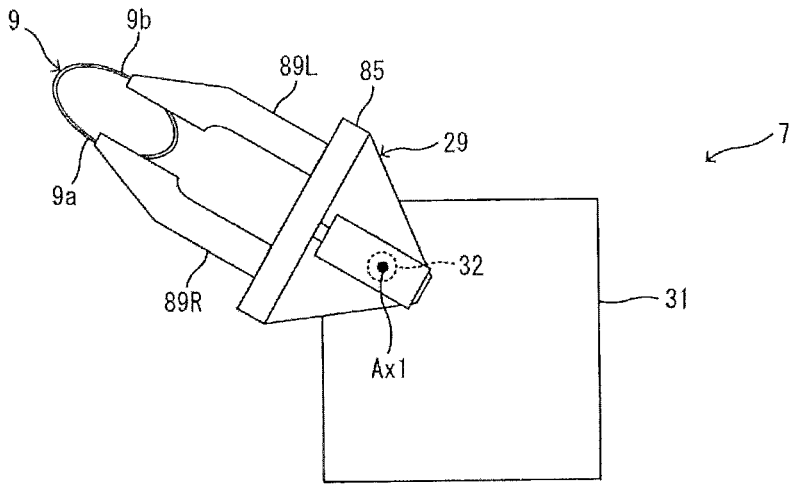
FIG. 10 is an explanatory diagram illustrating an example of the operation of opening the bag opening and moving the packaging bag executed by the hand of the bag opening device.
Figure 11:
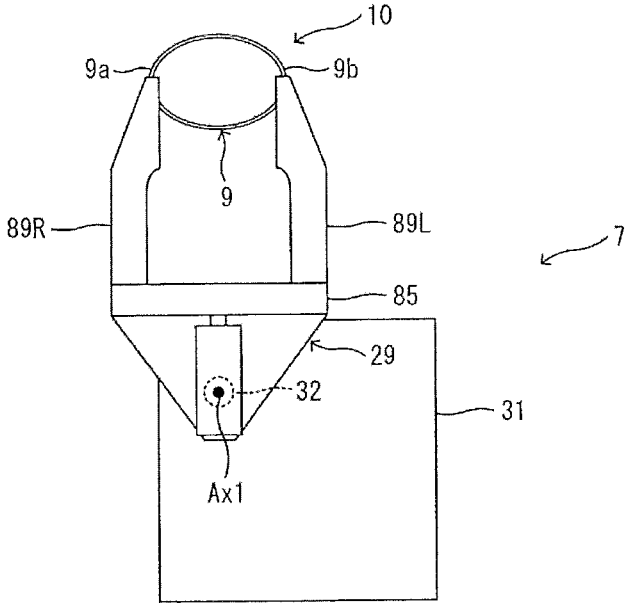
FIG. 11 is an explanatory diagram illustrating an example of the operation of opening the bag opening and moving the packaging bag executed by the hand of the bag opening device.
Figure 12:
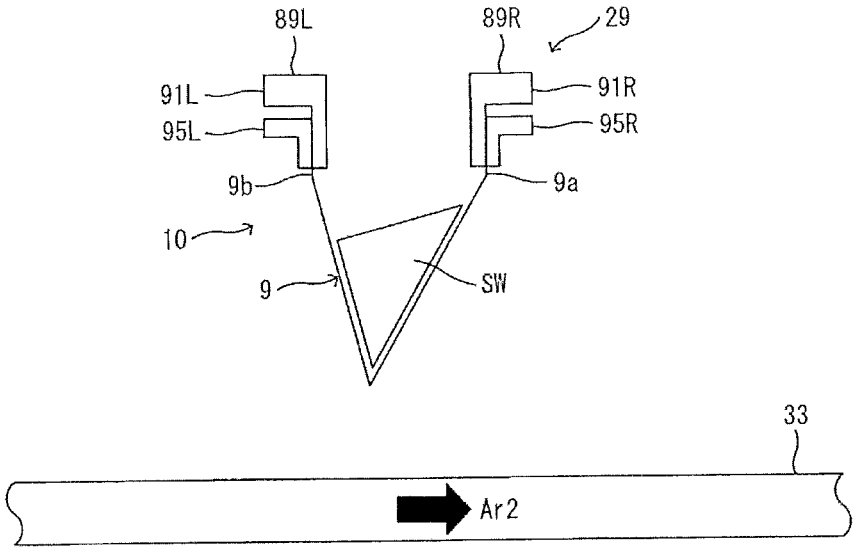
FIG. 12 is an explanatory diagram illustrating an example of the operation of gripping and releasing the packaging bag executed by the hand of the bag opening device.
Figure 13:
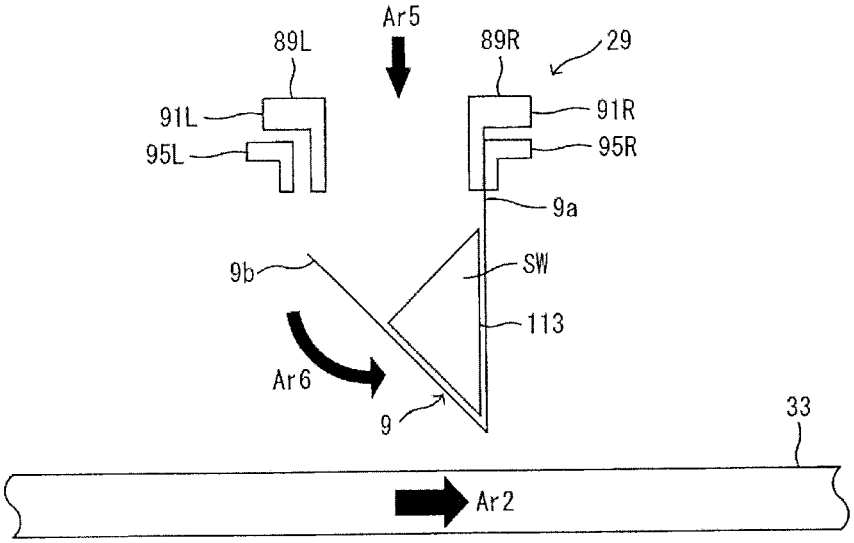
FIG. 13 is an explanatory diagram illustrating an example of the operation of gripping and releasing the packaging bag executed by the hand of the bag opening device.
Figure 14:
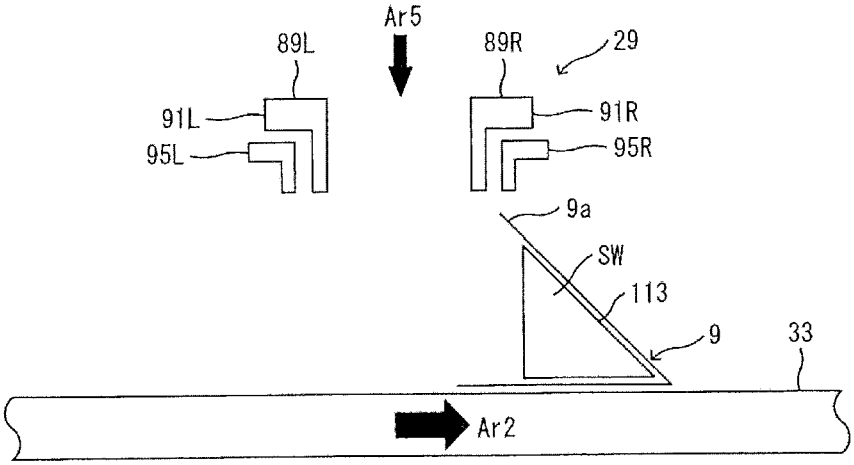
FIG. 14 is an explanatory diagram illustrating an example of the operation of gripping and releasing the packaging bag executed by the hand of the bag opening device.

Next, an example of the configuration of the hand 29 of the bag opening device 7 and the operation of the bag opening device 7 will be described using FIGS. 7 to 14. FIG. 7 is a perspective view illustrating an example of the configuration of the bag opening device 7 with the claws of the hand 29 closed. FIG. 8 is a perspective view illustrating an example of the configuration of the bag opening device 7 with the claws of the hand 29 open. FIGS. 9 to 11 are explanatory diagrams illustrating an example of the bag opening operation and the moving operation of the packaging bag 9 by the hand 29 of the bag opening device 7. FIGS. 12 to 14 are explanatory diagram illustrating an example of the grip release operation of the packaging bag 9 by the hand 29 of the bag opening device 7. Note that hereinafter, directions such as up, down, left, right, front, and back will be used as appropriate for convenience in describing the configuration of the bag opening device 7 and the like. However, the positional relationship between the components of the bag opening device 7 and the like are not limited thereto. Furthermore, portions not required for the description are omitted as appropriate in FIGS. 9 to 14.

As illustrated in FIGS. 7 and 8, the hand 29 includes an arm base 85, a motor base 86, a rack and pinion mechanism 87, gripping arms 89L, 89R, arm brackets 90L, 90R, fixed claws 91L, 91R, movable claw plates 93L, 93R, movable claws 95L, 95R, a motor 97, air cylinders 99L, 99R, and the like.

The arm base 85 is a substantially rectangular plate-like member. Hereinafter, for convenience of explanation, the configuration of the hand 29 will be described with the length direction of the arm base 85 corresponding to the left-and-right direction, the width direction corresponding to the up-and-down direction, and the thickness direction corresponding to the front-and-back direction.

The motor base 86 is a substantially trapezoidal plate-like member provided at the back of the arm base 85. The rotary-type motor 97 is disposed above the motor base 86 with its axial direction orientated to be substantially parallel with the front-and-back direction. The rack and pinion mechanism 87 is disposed on the front side of the arm base 85. The rack and pinion mechanism 87 includes a pinion 103 connected to an output shaft 101 of the motor 97, a rack 105L connected to the arm bracket 90L and engaged with the pinion 103, a rack 105R connected to the arm bracket 90R and engaged with the pinion 103, and the like. The pinion 103 is disposed in a substantially central portion of the front surface of the arm base 85, and the racks 105L, 105R are respectively disposed on the lower and upper sides of the pinion 103 in a manner allowing them to move in the left-and-right direction.

Also, guide rails 107L, 107R and sliders 109L, 109R are disposed on the front side of the arm base 85. The slider 109L is connected to the back portion of the arm bracket 90L and is movable in the left-and-right direction along the guide rail 107L. The slider 109R is connected to the back portion of the arm bracket 90R and is movable in the left-and-right direction along the guide rail 107R. According to the configuration described above, when the motor 97 (an example of a third actuator) is rotationally driven, the gripping arms 89L, 89R connected to the arm brackets 90L, 90R move toward or away from one another, opening or closing in the left-and-right direction.

The arm bracket 90L includes a base end portion 90La connected to the rack 105L and the slider 109L and a projection portion 90Lb projecting forward at the lower end of the base end portion 90La. The gripping arm 89L is connected to the lower portion of the projection portion 90Lb projecting forward. In a similar manner, the arm bracket 90R includes a base end portion 90Ra connected to the rack 105R and the slider 109R and a projection portion 90Rb projecting forward at the lower end of the base end portion 90Ra. The gripping arm 89R is connected to the lower portion of the projection portion 90Rb projecting forward.

The gripping arm 89L (an example of a second gripping member) includes a base end portion 89La and a tip portion 89Lb. The base end portion 89La is a plate-like member that is connected to the arm bracket 90L, has a width in the left-and-right direction that is substantially constant, and extends substantially parallel with the front-and-back direction. The tip portion 89Lb is a plate-like member that is provided on the front side of the base end portion 89La, includes an end portion on the right side (the side where the gripping arm 89R is located) that is offset to the right further than the base end portion 89La, and includes an end portion on the left side (the opposite side to where the gripping arm 89R is located) formed with a taper so that the width in the left-and-right direction decreases toward the tip. The fixed claw 91L is provided on the tip of the tip portion 89Lb. The fixed claw 91L is disposed hanging down from the tip of the gripping arm 89L a predetermined length.

The movable claw plate 93L is provided below the tip portion 89Lb. The movable claw plate 93L is rotatably connected to the tip portion 89Lb via a pin 111L. The movable claw 95L is provided on the tip of the movable claw plate 93L. The movable claw 95L is disposed hanging down from the tip of the movable claw plate 93L a predetermined length. Note that the length of each claw is set so that the lower end of the fixed claw 91L and the lower end of the movable claw 95L are approximately the same height.

The air cylinder 99L (an example of a fifth actuator) for rotating the movable claw plate 93L is provided on the lower portion of the base end portion 89La. When the air cylinder 99L extends, the movable claw plate 93L rotates counterclockwise (as seen from above) about the pin 111L, and the movable claw 95L comes into contact with the fixed claw 91L as illustrated in FIG. 7. In this manner, the gripping arm 89L grips the second side edge portion 9*b* of the opening 83 of the packaging bag 9 formed by the opening forming device 5 and supports the packaging bag 9 in a suspended state. On the other hand, when the air cylinder 99L contracts, the movable claw plate 93L rotates clockwise (as seen from above) about the pin 111L, and the movable claw 95L moves away from the fixed claw 91L as illustrated in FIG. 8. This causes the gripping arm 89L to release the grip.

The gripping arm 89R (an example of a first gripping member) has the same structure as the gripping arm 89L, but has a shape that is symmetrical in the left-and-right direction. That is, the gripping arm 89R includes a base end portion 89Ra and a tip portion 89Rb. The base end portion 89Ra is a plate-like member that is connected to the arm bracket 90R, has a width in the left-and-right direction that is substantially constant, and extends substantially parallel with the front-and-back direction. The tip portion 89Rb is a plate-like member that is provided on the front side of the base end portion 89Ra, includes an end portion on the left side (the side where the gripping arm 89L is located) that is offset to the left further than the base end portion 89Ra, and includes an end portion on the right side (the opposite side to where the gripping arm 89L is located) formed with a taper so that the width in the left-and-right direction decreases toward the tip. The fixed claw 91R is provided on the tip of the tip portion 89Rb. The fixed claw 91R is disposed hanging down from the tip of the gripping arm 89R a predetermined length.

The movable claw plate 93R is provided below the tip portion 89Rb. The movable claw plate 93R is rotatably connected to the tip portion 89Rb via a pin 111R. The movable claw 95R is provided on the tip of the movable claw plate 93R. The movable claw 95R is disposed hanging down from the tip of the movable claw plate 93R a predetermined length. Note that the length of each claw is set so that the lower end of the fixed claw 91R and the lower end of the movable claw 95R are approximately the same height.

The air cylinder 99R (an example of a fourth actuator) for rotating the movable claw plate 93R is provided on the lower portion of the base end portion 89Ra. When the air cylinder 99R extends, the movable claw plate 93R rotates clockwise (as seen from above) about the pin 111R, and the movable claw 95R comes into contact with the fixed claw 91R as illustrated in FIG. 7. In this manner, the gripping arm 89R grips the first side edge portion 9*a* of the opening 83 of the packaging bag 9 formed by the opening forming device 5 and supports the packaging bag 9 in a suspended state. On the other hand, when the air cylinder 99R contracts, the movable claw plate 93R rotates counterclockwise (as seen from above) about the pin 111R, and the movable claw 95R moves away from the fixed claw 91R as illustrated in FIG. 8. This causes the gripping arm 89R to release the grip.

According to the configuration described above, the hand 29 of the bag opening device 7 grips the second side edge portion 9*b* of the opening 83 of the packaging bag 9 with the gripping arm 89L and grips the first side edge portion 9*a* of the opening 83 of the packaging bag 9 with the gripping arm 89R and, in this state, opens the gripping arms 89L, 89R in the left-and-right direction to widen the opening 83 in the left-and-right direction (an example of a first direction) and open the bag opening.

Next, the operation of opening the bag opening and the operation of moving the packaging bag 9 with the hand 29 of the bag opening device 7 will be described using FIGS. 9 to 11. As illustrated in FIG. 9, the moving device 31 of the bag opening device 7 swivels to make the hand 29 face toward the opening forming device 5. The opening 83 is formed at the bag opening of the packaging bag 9 by the opening forming device 5 (not illustrated in FIG. 9). The hand 29 grips the second side edge portion 9*b* of the opening 83 with the gripping arm 89L and grips the first side edge portion 9*a* of the opening 83 with the gripping arm 89R.

Next, as illustrated in FIG. 10, the moving device 31 swivels to make the hand 29 face the storing position 10 above the conveyor 33. In parallel with this swivel operation, the hand 29 opens the gripping arms 89L, 89R to open the bag opening of the packaging bag 9. Then, as illustrated in FIG. 11, the hand 29 fully opens the bag opening of the packaging bag 9 before the hand 29 arrives at the storing position 10 and then stops at the storing position 10. In this state, the sandwich SW is inserted into the packaging bag 9 from the bag opening.

Next, the operation of releasing the grip of the hand 29 of the bag opening device 7 will be described using FIGS. 12 to 14. As illustrated in FIG. 12, at the storing position 10 above the conveyor 33, the sandwich SW is stored in the packaging bag 9 held in a state with the bag opening opened by the hand 29.

Next, as illustrated in FIG. 13, the moving device 31 moves the hand 29 down (indicated by arrow Ar5) and, of the gripping arms 89L, 89R of the hand 29, the gripping arm 89L located upstream in the conveyance direction (indicated by the arrow Ar2) of the conveyor 33 releases its grip on the edge portion 9*b* of the packaging bag 9, releasing the edge portion 9*b*. Accordingly, the packaging bag 9 swings in the direction of arrow Ar6 about the position where the gripping arm 89R grips the packaging bag 9.

Then, as illustrated in FIG. 14, the moving device 31 moves the hand 29 further down (indicated by the arrow Ar5), and the gripping arm 89R located downstream releases its grip on the edge portion 9*a* of the packaging bag 9, releasing the packaging bag 9. In this manner, the packaging bag 9 can be smoothly placed on the conveyor 33 utilizing the swinging motion with a cut surface 113 of the sandwich SW facing downstream. Also, a soft release can be achieved in which the impact when the packaging bag 9 storing the sandwich SW is dropped onto the conveyor 33 is reduced.

4. Control Configuration of Bag Supply System

Figure 15:
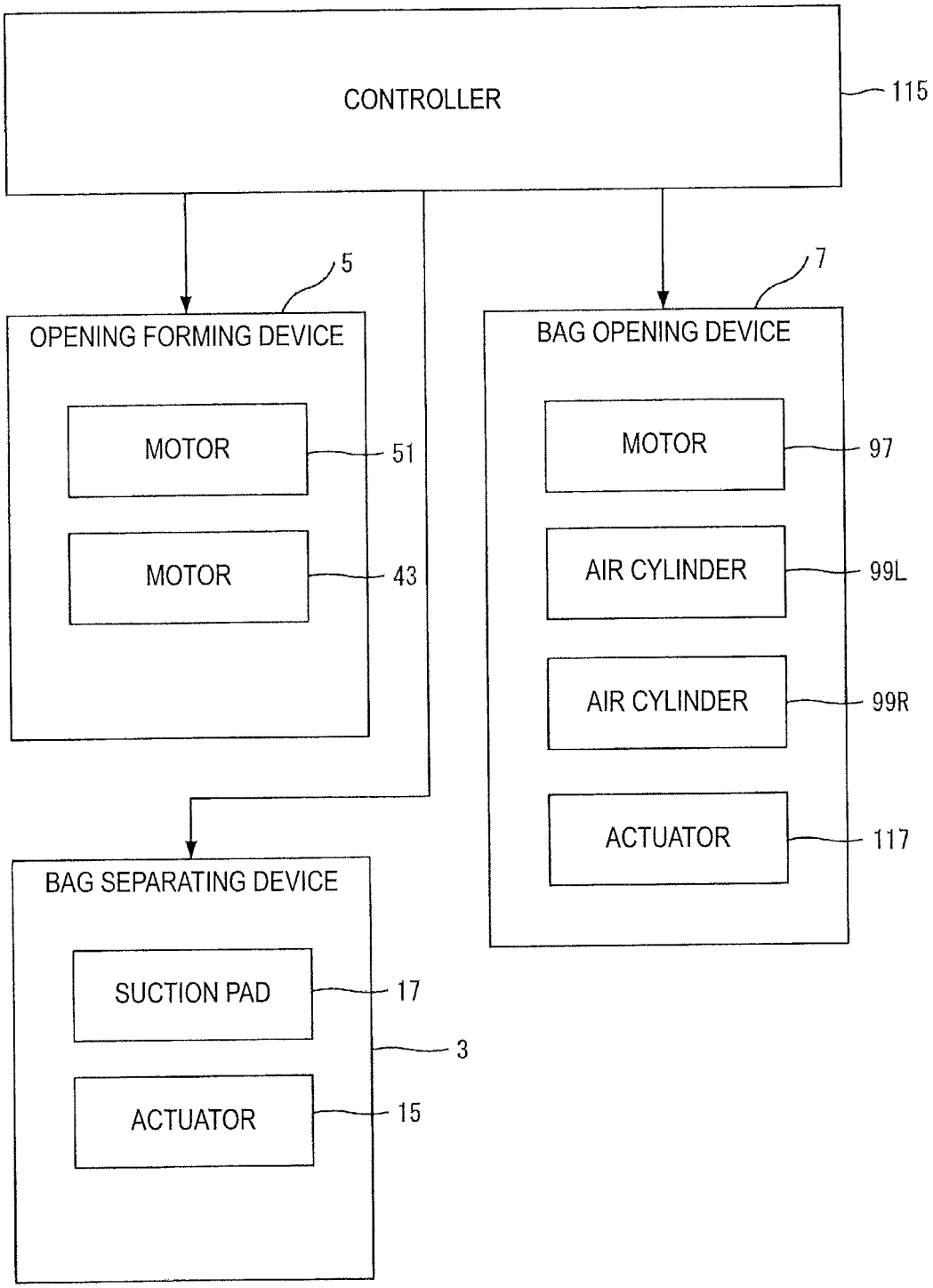
FIG. 15 is a block diagram illustrating an example of the control configuration of the bag supply system.

Next, an example of the control configuration of the bag supply system 1 will be described using FIG. 15. As illustrated in FIG. 15, the bag supply system 1 includes a controller 115. The controller 115 is constituted by, for example, a motion controller, a personal computer (PC), a programmable logic controller (PLC), or the like.

The controller 115 controls the operation of the bag separating device 3 by controlling the driving of the suction pads 17 (for example, a vacuum pump or a solenoid valve for suction) and the actuator 15 of the bag separating device 3. Also, the controller 115 controls the operation of the opening foaming device 5 by controlling the driving of the motors 51, 43 of the opening forming device 5. Specifically, for example, the controller 115 controls the motors 43, 51 to move the holding plates 25L, 25R a small amount away from one another, and then to cause the friction member 81 of the rollers 27L, 27R to act against the friction member 67 of the holding plates 25L, 25R to form the opening 83.

Also, the controller 115 controls the operation of the bag opening device 7 by controlling the driving of the motor 97, the air cylinders 99L, 99R, and the actuator 117 of the bag opening device 7. Specifically, for example, the controller 115 controls the motor 97 and the actuator 117 to execute, in parallel, the driving for the swivel and vertical movement of the hand 29 and the opening and closing of the gripping arms 89L, 89R. Also, for example, the air cylinders 99L, 99R are controlled so that, of the gripping arms 89L, 89R, the gripping arm 89L located upstream in the conveyance direction of the conveyor 33 where the packaging bag 9 is placed as the supply destination releases the edge portion 9*b* of the packaging bag 9 first, and then the gripping arm 89R located downstream releases the edge portion 9*a* of the packaging bag 9.

Note that the functions of the controller 115 described above may be implemented by a program executed by CPU 901 (see FIG. 24) described below, or one or more or all of the functions may be implemented by actual devices such as ASICs, FPGAs, or other electrical circuits.

5. Control Process of Controller

Figure 16:
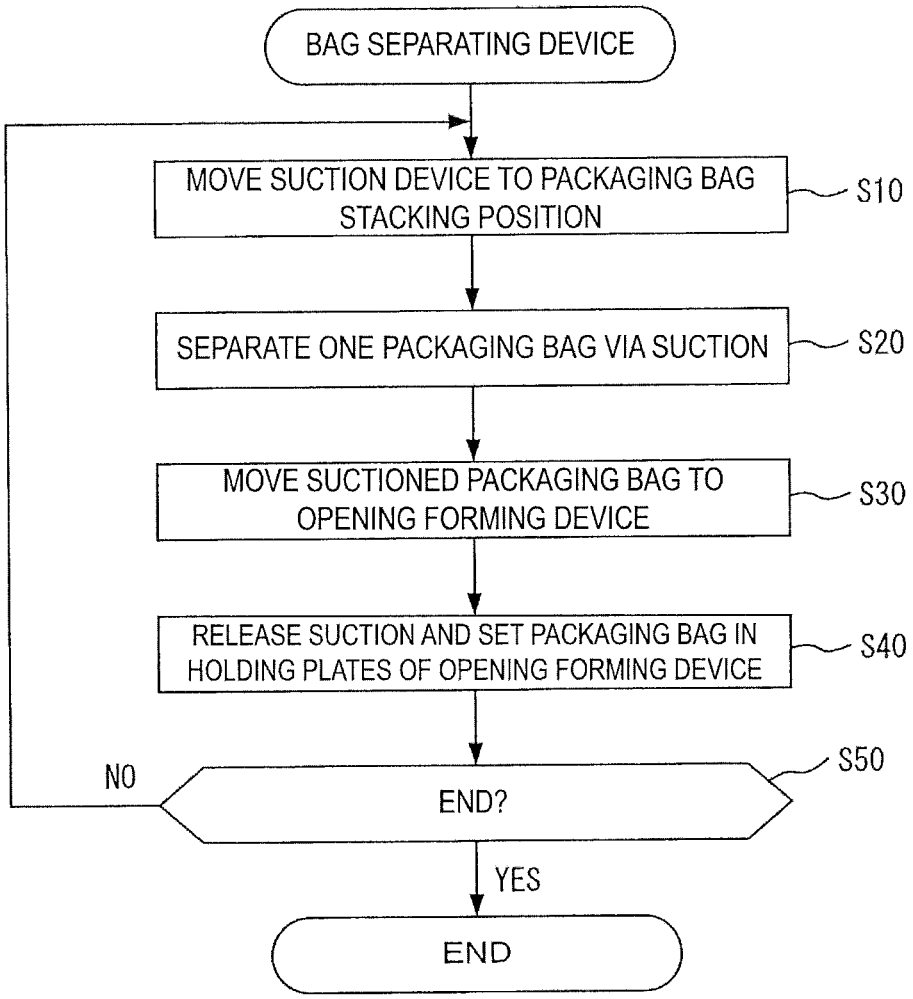
FIG. 16 is a flowchart illustrating an example of the control process relating to the bag separating device executed by a controller.

Next, an example of the control process relating to the bag separating device 3 executed by the controller 115 will be described using FIG. 16.

In step S10, the controller 115 controls the actuator 15 to move the suction device 13 provided with the suction pads 17 to the position where the packaging bag 9 are stacked and held by the bag holder 11.

In step S20, the controller 115 controls a vacuum pump, a solenoid valve, or the like, for example, to separate, via suction by the suction pads 17, one packaging bag 9 from the plurality of stacked packaging bags 9.

In step S30, the controller 115 controls the actuator 15 to move the suction device 13 holding one packaging bag 9 to the opening forming device 5.

In step S40, the controller 115 controls a vacuum pump, a solenoid valve, or the like, for example, to release the suction of the suction pads 17 at the opening forming device 5 and set the packaging bag 9 in the holding plates 25L, 25R.

In step S50, the controller 115 determines whether to end the operation of the bag separating device 3. In a case where the operation is not to be ended (NO in step S50), the process returns to step S10 and repeats. In a case where the operation is to be ended (YES in step S50), the present flow ends.

Figure 17:
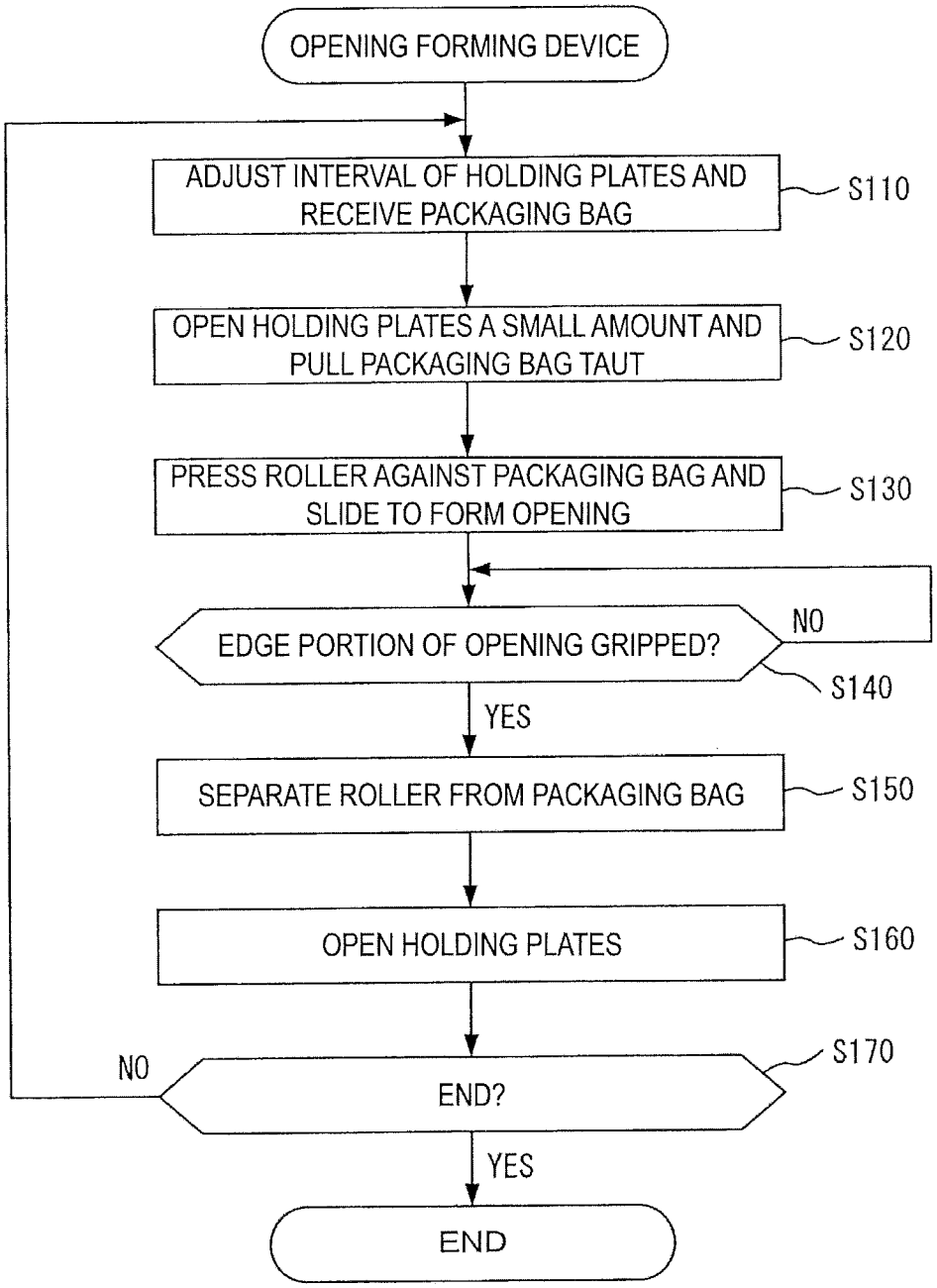
FIG. 17 is a flowchart illustrating an example of the control process relating to the opening forming device executed by the controller.

Next, an example of the control process relating to the opening forming device 5 executed by the controller 115 will be described using FIG. 17.

In step S110, the controller 115 controls the motor 43 to adjust the interval between the holding plates 25L, 25R to the size of the packaging bag 9, and the packaging bag 9 is received.

In step S120, the controller 115 controls the motor 43 to increase the interval between the holding plates 25L, 25R by a small amount, pulling the packaging bag 9 taut.

In step S130, the controller 115 controls the motor 51 to bring the rollers 27L, 27R into contact with the packaging bag 9 and then slide the friction member 81 of the rollers 27L, 27R toward a central region in the left-and-right direction while the friction member 81 is pressed against the friction member 67 of the holding plates 25L, 25R, thus forming the opening 83.

In step S140, the controller 115 determines whether the edge portions 9*a*, 9*b* of the opening 83 have been gripped by the hand 29 of the bag opening device 7. The present step S140 is repeated (NO in step S140) until gripping is successful, and when gripping is successful (YES in step S140), the process moves to step S150.

In step S150, the controller 115 controls the motor 51 to separate the rollers 27L, 27R from the packaging bag 9.

In step S160, the controller 115 controls the motor 43 to open the holding plates 25L, 25R to a preset interval.

In step S170, the controller 115 determines whether to end the operation of the opening forming device 5. In a case where the operation is not to be ended (NO in step S170), the process returns to step S110 and repeats. In a case where the operation is to be ended (YES in step S170), the present flow ends.

Figure 18:
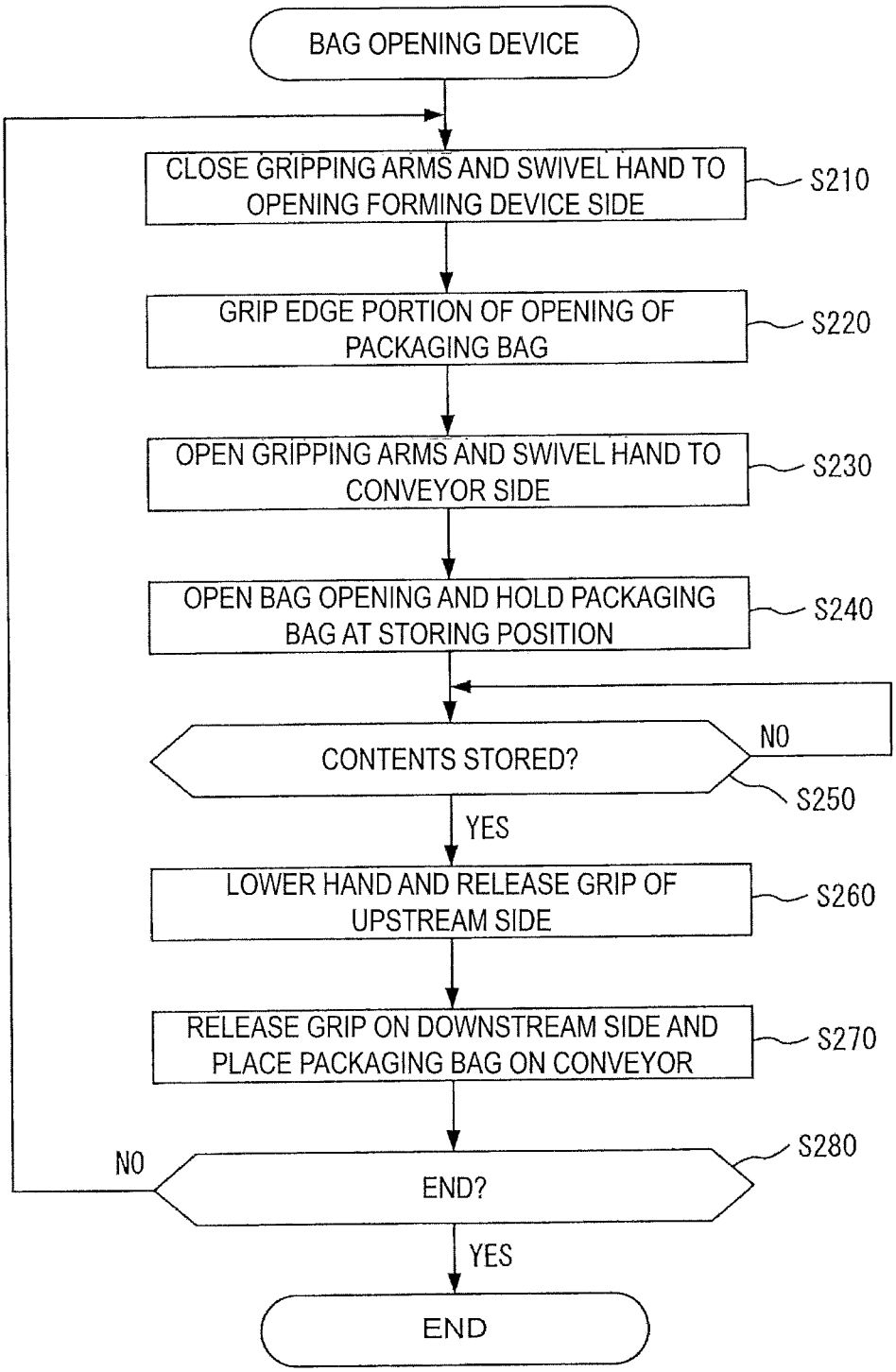
FIG. 18 is a flowchart illustrating an example of the control process relating to the bag opening device executed by the controller.

Next, an example of the control process relating to the bag opening device 7 executed by the controller 115 will be described using FIG. 18.

In step S210, the controller 115 controls the motor 97 and the actuator 117 to swivel the hand 29 to face toward the opening forming device 5 while closing the gripping arms 89L, 89R of the hand 29.

In step S220, the controller 115 controls the motor 97 and the actuator 117 to move the tips of the gripping arms 89L, 89R to the bag opening of the packaging bag 9, and controls the air cylinders 99L, 99R to move the movable claws 95L, 95R so that the hand 29 grips the edge portions 9*a*, 9*b* of the opening 83 formed at the bag opening.

In step S230, the controller 115 controls the motor 97 and the actuator 117 to swivel the hand 29 to face toward the conveyor 33 while opening the interval between the gripping arms 89L, 89R supporting the packaging bag 9 in a suspended state.

In step S240, the controller 115 controls the motor 97 and the actuator 117 to hold the packaging bag 9 at the storing position 10 with the bag opening of the packaging bag 9 fully opened by the gripping arms 89L, 89R.

In step S250, the controller 115 determines whether the contents (the sandwich SW in the present embodiment) have been stored in the packaging bag 9. The present step S250 is repeated (NO in step S250) until the contents are stored, and when the contents are stored (YES in step S250), the process moves to step S260.

In step S260, the controller 115 controls the actuator 117 and the air cylinder 99L to release the grip of the gripping arm 89L located upstream in the conveyance direction of the conveyor 33 while lowering the hand 29.

In step S270, the controller 115 controls the actuator 117 and the air cylinder 99R to release the grip of the gripping arm 89R located downstream in the conveyance direction of the conveyor 33 while further lowering the hand 29, placing the packaging bag 9 on the conveyor 33.

In step S280, the controller 115 determines whether to end the operation of the bag opening device 7. In a case where the operation is not to be ended (NO in step S280), the process returns to step S210 and repeats. In a case where the operation is to be ended (YES in step S280), the present flow ends.

6. Effects of the Embodiment

As described above, the bag supply system 1 of the present embodiment includes the opening forming device 5 configured to form the opening 83 at the bag opening of the packaging bag 9 and the bag opening device 7 configured to grip each of the first side edge portion 9*a* and the second side edge portion 9*b* of the opening 83 with respect to the opening direction, the opening direction being a direction in which the opening 83 opens, (the front-and-back direction in FIGS. 3 to 6 and the left-and-right direction in FIGS. 7 and 8) and open the bag opening by widening the opening 83 in the opening direction.

For example, in a case where both ends in a planar direction of the packaging bag 9 in a flattened state are gripped, a suction means such as a suction pad is used to widen the bag opening in the opening direction (the direction perpendicular to the planar direction), and a spatula is used to form an opening shape, gripping the packaging bag 9 at both ends in the direction perpendicular to the opening direction may result in an unstable opening shape due to, for example, a small opening shape being formed due to opening size limitations, the opening not being cleanly formed due to unstable suction, the shape collapsing before the contents are inserted due to the opening not being retained after the spatula is removed, and the like.

In the present embodiment, the opening 83 is first formed at the bag opening and then the edge portions of the opening 83 are gripped. This allows the opening 83 forming process and the gripping process to be separated, which then allows the edge portions of the opening 83 to be gripped on the sides in the opening direction. Accordingly, the opening shape can be fully expanded and the bag opening can be stably and cleanly opened by supporting the edge portions 9*a*, 9*b* and not by suction. This allows the opening shape to be retained without collapsing. In this manner, the packaging bag 9 with a stable opening shape can be supplied. Also, a shaping step using a spatula or the like is unnecessary, thus simplifying the process.

Also, in the present embodiment, specifically, the opening forming device 5 forms the opening 83 by sliding the first side edge portion 9*a* and the second side edge portion 9*b* of the bag opening relative to one another in the planar direction (the left-and-right direction in FIGS. 3 to 6) perpendicular to the opening direction.

This enables the opening 83 to be smoothly formed. Also, a supply system gentle on bags can be achieved in which the opening 83 can be stably formed without suction and suction marks and the like can be prevented.

Also, in the present embodiment, specifically, the opening forming device 5 includes the motor 51 configured to cause the friction member 81 of the rollers 27L, 27R, which comes into contact with the first side edge portion 9*a* of the opening 83 and causes friction with the first side edge portion 9*a*, and the friction member 67 of the holding plates 25L, 25R, which comes into contact with the second side edge portion 9*b* of the opening 83 and causes friction with the second side edge portion 9*b*, to move in opposite directions in the planar direction.

In this manner, the first side edge portion 9*a* of the bag opening that comes into contact with the friction member 81 can be slid in the planar direction relative to the second side edge portion 9*b* of the bag opening that comes into contact with the friction member 67. Thus, by providing a friction member for causing friction at the portion that comes into contact with the packaging bag 9, the opening 83 can be stably formed.

Also, in the present embodiment, specifically, the motor 51 is a rotary-type motor, and the opening forming device 5 includes a link mechanism (the links 41L, 41R, the links 47, 49, and the like) configured to, via rotation of the motor 51, press the friction member 81 against the friction member 67 in the opening direction and move the friction member 81 in the planar direction relative to the friction member 67.

In this manner, two operations of pressing and sliding the friction member 81 relative to the friction member 67 can be executed with the single motor 51. Thus, the number of actuators can be reduced.

Also, in the present embodiment, specifically, the opening forming device 5 includes the holding plate 25L configured to hold a first side of the packaging bag 9 in the planar direction, the holding plate 25R configured to hold a second side of the packaging bag 9 in the planar direction, and the motor 43 configured to move the holding plates 25L, 25R toward and away from one another in the planar direction, and the holding plates 25L, 25R are each installed with the friction member 67 and are each connected to the friction member 81 in a manner allowing the friction member 81 to act against each of the holding plates 25L, 25R.

In this manner, various types of packaging bags 9 with different widths in the planar direction can be held, and the bag opening can be opened by forming the opening 83. Thus, the opening forming device 5 can handle packaging bags with a wide variety of bag widths. Furthermore, maintenance can be improved in terms of, for example, when a bag is jammed or the like, the bag can be easily discharged by fully opening the holding plates 25L, 25R.

Also, in the present embodiment, specifically, the bag supply system 1 includes the controller 115 configured to control the motors 43, 51 to move the holding plates 25L, 25R a small amount away from one another and then to cause the friction member 81 of the rollers 27L, 27R to act against the friction member 67 of the holding plates 25L, 25R to form the opening 83.

This allows the packaging bag 9 to be pulled taut before the opening 83 is formed. That is, the open state can be formed by the rear surface (the surface on the edge portion 9*b* side) of the packaging bag 9 being pulled taut, and the front surface (the surface on the edge portion 9*a* side) of the packaging bag 9 being drawn toward a central region. As a result, a clean opening shape can be created.

Also, in the present embodiment, specifically, the bag opening device 7 includes the gripping arm 89R configured to grip the first side edge portion 9*a* of the opening 83 and support the packaging bag 9 in a suspended state, the gripping arm 89L configured to grip the second side edge portion 9*b* of the opening 83 and support the packaging bag 9 in a suspended state, and the motor 97 configured to move the gripping arms 89R, 89L toward and away from one another in the opening and closing direction (the left-and-right direction in FIGS. 7 and 8).

In this manner, the bag opening can be opened by the gripping arms 89L, 89R supporting the packaging bag 9 in a suspended state and the gripping arms 89L, 89R being moved away from one another. Thus, the support member for the packaging bag 9 and the member for widening the bag opening can be shared, allowing the system configuration to be simplified.

Also, in the present embodiment, specifically, the bag opening device 7 includes the moving device 31 configured to move the packaging bag 9 supported in a suspended state by the gripping arms 89L, 89R from a region at or near the opening forming device 5 to a region at or near a supply destination of the packaging bag 9.

In this manner, with the bag opening device 7, opening the bag opening of the packaging bag 9 and conveying the packaging bag 9 from the opening forming device 5 to the supply destination can both be performed. Thus, a separate conveying device for conveying the packaging bag 9 does not need to be provided, allowing the system configuration to be simplified.

Also, in the present embodiment, specifically, the bag supply system 1 includes the controller 115 configured to control the actuator 117 and the motor 97 to execute in parallel movement of the packaging bag 9 by the moving device 31 and movement of the gripping arms 89L, 89R by the motor 97.

In this manner, while the packaging bag 9 is being moved from the opening forming device 5 to the supply destination, the bag opening can be opened by opening the gripping arms 89L, 89R. Also, the gripping arms 89L, 89R can be closed while the gripping arms 89L, 89R are being returned to the opening forming device 5 from the supply destination. Thus, the time (cycle time) for supplying one packaging bag 9 can be reduced.

Also, in the present embodiment, specifically, the bag opening device 7 includes the air cylinder 99L configured to cause the gripping arm 89L to operate to grip and release the first side edge portion 9*b* of the opening 83, and the air cylinder 99R configured to cause the gripping arm 89R to operate to grip and release the second side edge portion 9*a* of the opening 83, and the controller 115 controls the air cylinders 99L, 99R such that the gripping arm 89L of the gripping arms 89L, 89R that is located upstream in the conveyance direction of the conveyor 33, which is the supply destination where the packaging bag 9 is placed, releases the edge portion 9*b* first, and then the gripping arm 89R that is located downstream releases the edge portion 9*a*.

In this manner, the impact when the packaging bag 9 with the sandwich SW inserted is dropped onto the conveyor 33 at the conveying destination can be reduced. Thus, the bag supply system 1 capable of a soft release can be achieved.

7. Modified Examples

Note that the present disclosure is not limited to the embodiment described above, and various modifications are possible within a range that does not depart from the spirit and technical ideas of the present disclosure. Such modified examples will be described below.

7-1. Example of Rotationally Driving Roller to Form Opening

With the structure of the embodiment described above, the rollers 27L, 27R are fixed and swing together with the links 41L, 41R. However, a structure may be used in which the rollers 27L, 27R are rotationally driven. The opening forming operation according to the present modified example will be described using FIGS. 19 to 21.

Figure 19:
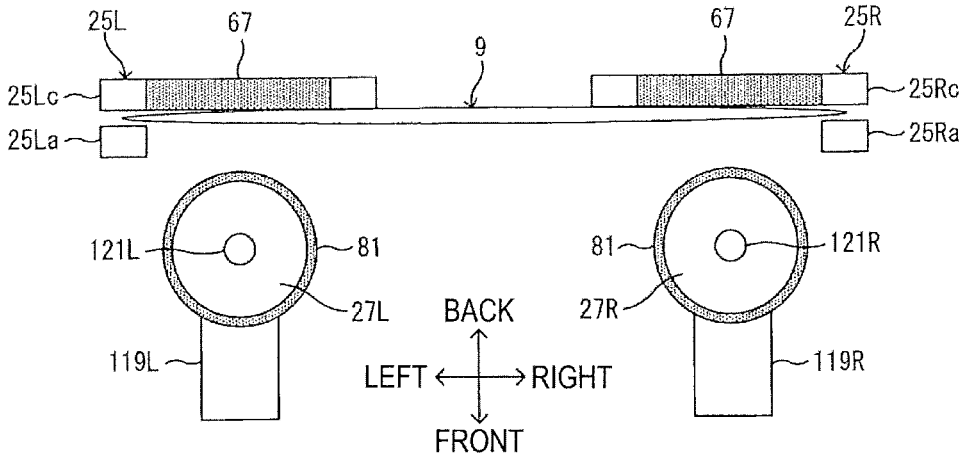
FIG. 19 is an explanatory diagram illustrating an example of the opening forming operation according to a modified example in which rollers are rotationally driven to form the opening.

As illustrated in FIG. 19, the rollers 27L, 27R (an example of a roller member) are supported by roller arms 119L, 119R in a manner allowing for rotation about shaft members 121L, 121R, respectively. The shaft members 121L, 121R are erected substantially parallel with the up-and-down direction orthogonal to the opening direction (front-and-back direction) of the packaging bag 9 and the planar direction (the left-and-right direction) of the packaging bag 9. The rollers 27L, 27R are individually, rotationally driven by two non-illustrated rotary motors (an example of a first actuator). The roller arms 119L, 119R are respectively connected to the arms 39L, 39R described above. When the distance between the upper end portion of the arms 39L, 39R and the holding plates 25L, 25R is greater than a predetermined distance, the friction member 81 of the rollers 27L, 27R is separated from the friction member 67 of the holding plates 25L, 25R, as illustrated in FIG. 19. In this state, the packaging bag 9 is inserted into the holding plates 25L, 25R.

Figure 20:
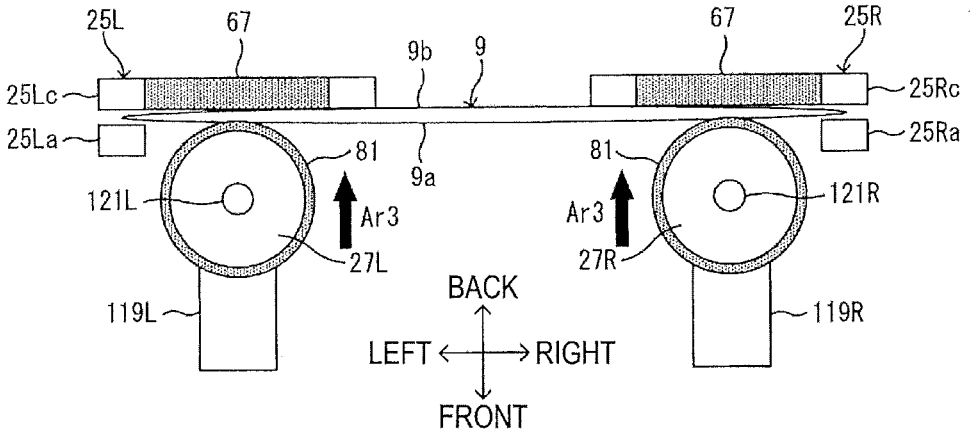
FIG. 20 is an explanatory diagram illustrating an example of the opening forming operation according to a modified example in which the rollers are rotationally driven to form the opening.
Figure 21:
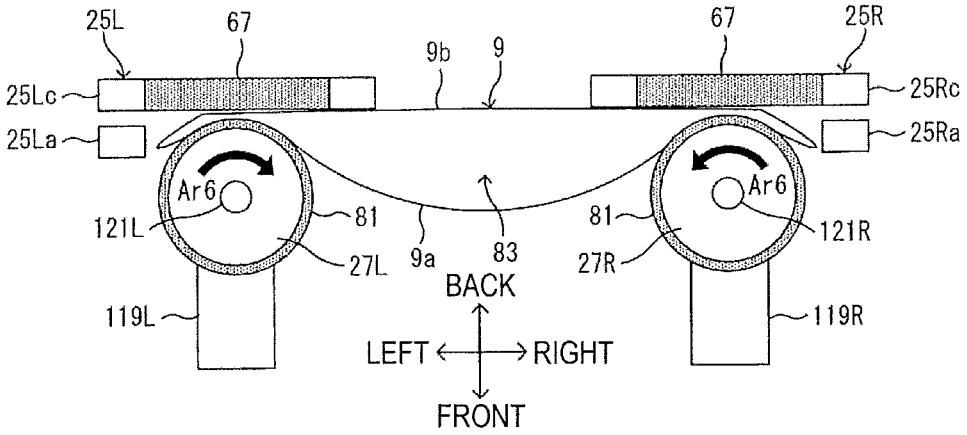
FIG. 21 is an explanatory diagram illustrating an example of the opening forming operation according to a modified example in which the rollers are rotationally driven to form the opening.

Next, when the arms 39L, 39R are rotated toward the holding plates 25L, 25R by the rotational drive of the motor 51, as illustrated in FIG. 20, the rollers 27L, 27R move backward (indicated by arrow Ar3) and the friction member 81 of the rollers 27L, 27R come into contact with the friction member 67 of the holding plates 25L, 25R, sandwiching the packaging bag 9. In this manner, the friction member 81 of the rollers 27L, 27R comes into contact with a front edge portion 9*a* (an example of a first side edge portion) of the packaging bag 9, and the friction member 67 of the holding plates 25L, 25R comes into contact with a back edge portion 9*b* (an example of a second side edge portion) of the packaging bag 9.

Then, the rollers 27L, 27R are rotated in the direction of the arrow Ar6 about the shaft members 121L, 121R by driving the non-illustrated rotary motors. In this manner, the front edge portion 9*a* of the bag opening of the packaging bag 9 slides, relative to the back edge portion 9*b*, from the left and right sides toward a central region forming a bulge, this bulge corresponding to an opening 83 formed from the bag opening of the packaging bag 9.

According to the present modified example, the links 41L, 41R, the coil springs, and the like of the embodiment described above are not necessary, allowing the opening forming device 5 to be simplified. Also, by controlling the angle of rotation and the rotational speed of the motor, for example, the size of the opening 83 formed can be adjusted and other such fine control can be performed.

7-2. Example of Installing Rollers at Incline with Respect to Horizontal Direction In the structure of the embodiment described above, the rollers 27L, 27R are installed substantially parallel with the horizontal direction (the left-and-right direction in FIG. 3). However, a structure may be used in which, depending on the shape of the packaging bag 9, the rollers 27L, 27R are inclined with respect to the horizontal direction. An example of the structure of the present modified example will be described using FIGS. 22 and 23.

Figure 22:
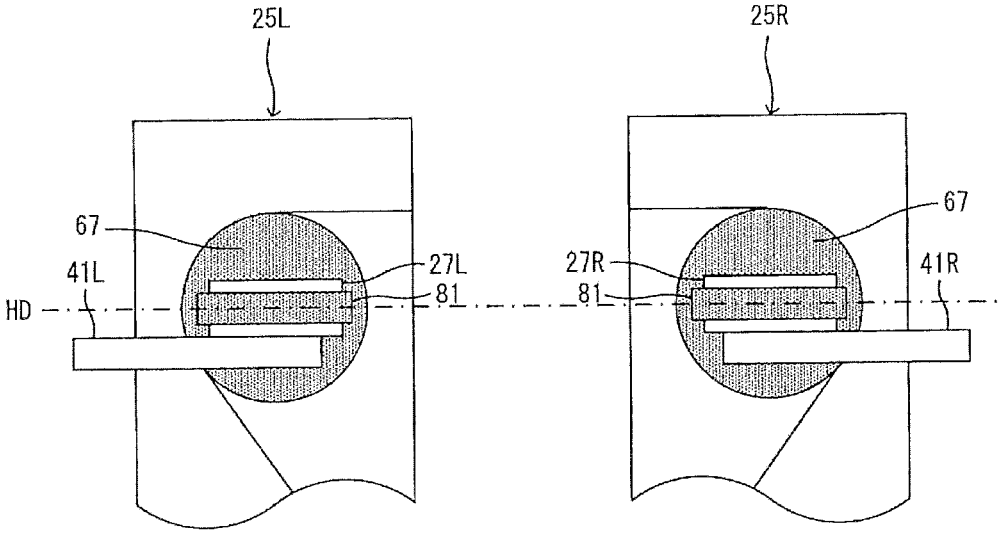
FIG. 22 is an explanatory diagram illustrating an example of a structure in which the rollers are installed parallel with the horizontal direction.

In FIG. 22, for the sake of comparison with the present modified example, the installation structure of the rollers 27L, 27R in the embodiment described above is illustrated. As illustrated in FIG. 22, the rollers 27L, 27R are respectively installed on the links 41L, 41R orientated to be substantially parallel with a horizontal direction HD.

Figure 23:
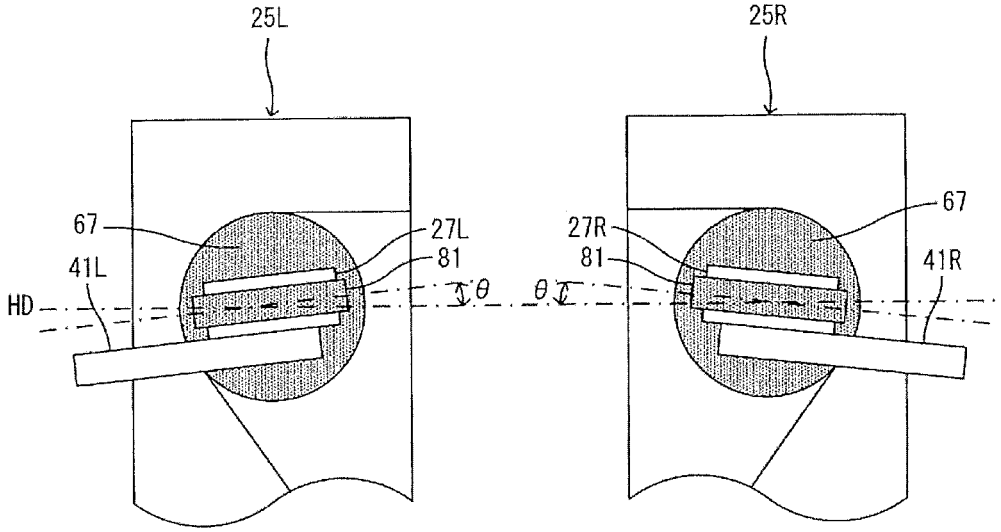
FIG. 23 is an explanatory diagram illustrating an example of a structure in which the rollers are installed at an incline with respect to the horizontal direction.

In the present modified example, as illustrated in FIG. 23, the rollers 27L, 27R are respectively installed on the links 41L, 41R orientated to be inclined by an angle θ with respect to the horizontal direction HD. For example, a structure can be used in which, by installing the link brackets 79L, 79R at an incline with respect to the arms 39L, 39R, the links 41L, 41R and the rollers 27L, 27R can be swung in a direction inclined by the angle θ. The angle θ is set so that the inclined direction corresponds with the direction perpendicular to a tapered portion 9*t* (see FIG. 2) of the packaging bag 9, for example. In this manner, the opening 83 can be more easily formed by the first side edge portion 9*a* and the second side edge portion 9*b* of the packaging bag 9 being moved relative to one another in the inclined direction (an example of a second direction). Furthermore, the angle θ may be set to adjust the shape of the opening 83 to a predetermined shape.

7-3. Supplement

In the embodiments described above, the opening forming device 5 includes two rollers. However, two rollers are not necessary, and the number of rollers may be one. For example, a structure may be used in which the holding plate 25L on the left side of the packaging bag 9 functions only to grip, and the roller 27R on the right side of the packaging bag 9 has the function of sliding in the left direction. The opening 83 can also be formed at the bag opening of the packaging bag 9 with this structure.

8. Example of Hardware Configuration of Controller

Next, an example of the hardware configuration of the controller 115 will be described using FIG. 24. Note that in FIG. 24, configurations relating to the functions for supplying power to the actuators of the controller 115 are omitted.

Figure 24:
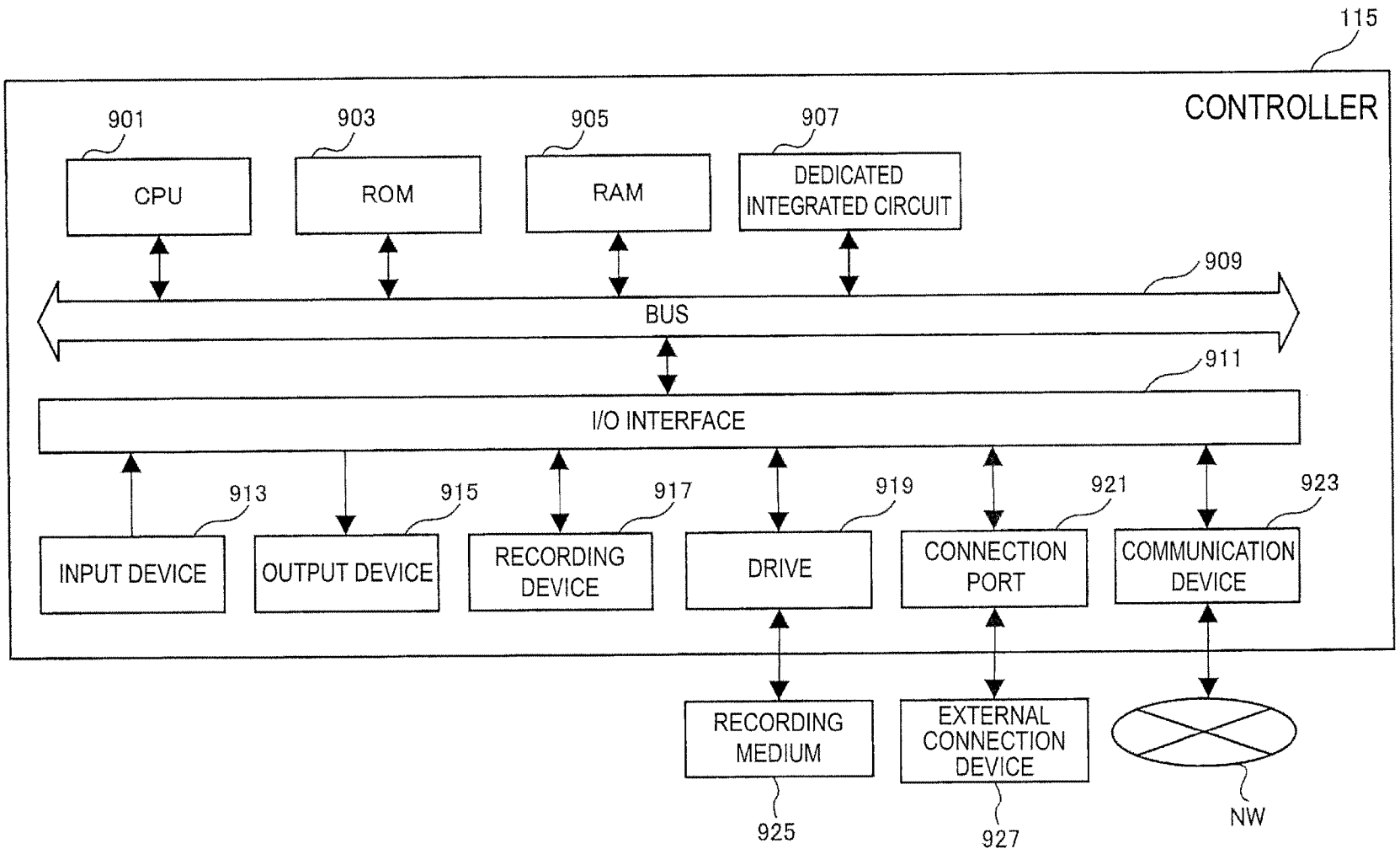
FIG. 24 is a block diagram illustrating an example of the hardware configuration of the controller.

As illustrated in FIG. 24, the controller 115 includes the CPU 901, ROM 903, RAM 905, a dedicated integrated circuit 907 built for a particular application such as an ASIC or FPGA, an input device 913, an output device 915, a recording device 917, a drive 919, a connection port 921, and a communication device 923. These components are connected in a manner allowing signals to be transmitted to one another via a bus 909 or an I/O interface 911.

The program may be recorded in the ROM 903, the RAM 905, the recording device 917, or the like.

Also, the program may be temporarily or non-temporarily (permanently) recorded on a recording medium 925, examples of which include a magnetic disk such as a flexible disk, an optical disk such as various CD and MO disks, a DVD, or the like, and a removable medium such as a semiconductor memory or the like. The recording medium 925 configured in such a manner may be provided as so-called package software. In this case, the program recorded on the recording medium 925 may be read out by the drive 919 and recorded to the recording device 917 via the I/O interface 911, the bus 909, and the like.

The program may also be recorded on, for example, a download site, another computer, another recording device, or the like (not illustrated). In this case, the program is transferred via a network NW, such as a LAN or the Internet and received by the communication device 923. The program received by the communication device 923 may be recorded on the recording device 917 via the I/O interface 911, the bus 909, and the like.

The program may also be recorded on an external connection device 927 as appropriate, for example. In this case, the program may be transferred via the connection port 921 as appropriate and recorded on the recording device 917 via the I/O interface 911, the bus 909, and the like.

Then, the CPU 901 executes various items of processing according to the program recorded on the recording device 917 to implement the processing executed by the controller 115 described above. At this time, the CPU 901 may directly read out the program from the recording device 917 and execute the program or may load the program on the RAM 905 before executing the program. Also, for example, in a case where the program is received via the communication device 923, the drive 919, or the connection port 921, the received program may be directly executed by the CPU 901 without it being recorded on the recording device 917.

Also, as necessary, the CPU 901 may perform various items of processing on the basis of signals and information input from the input device 913, examples of which include a mouse, a keyboard, a microphone, and the like (not illustrated).

The CPU 901 may output the result of the executed processing from the output device 915, examples of which include a display device, an audio output device, and the like, and also as necessary the CPU 901 may transmit the processing result via the communication device 923 or the connection port 921 or may record the processing result on the recording device 917 or the recording medium 925.

Note that in a case where "perpendicular", "parallel", "flat/planar", and the like are used in the description above, the meanings are not construed strictly. That is, "perpendicular", "parallel", and "flat/planar" mean "substantially perpendicular", "substantially parallel", and "substantially flat/planar", respectively, with allowance for design and manufacturing tolerances and errors.

Also, in a case where "the same", "identical", "equal", "different" and the like are used in the description above in reference to the external dimensions and size, the shape, the position, or the like, the meanings are not construed strictly. That is, "the same", "identical", "equal", and "different" mean "substantially the same", "substantially identical", "substantially equal", and "substantially different", respectively, with allowance for design and manufacturing tolerances and errors.

Furthermore, in addition to the embodiments described above, the techniques according to the embodiment and the modified examples may be used in combination as appropriate. Also, while examples are not described, various modifications may be made to the above-described embodiments or modified examples within a range that does not depart from the technical scope thereof.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A bag supply system configured to supply a packaging bag, comprising:

an opening forming device configured to form an opening at a bag opening of the packaging bag; and a bag opening device configured to support each of a first side edge portion and a second side edge portion, of the opening formed, in a first direction, the first direction being a direction in which the opening is opened, and open the bag opening by widening the opening in the first direction, wherein the bag opening device comprises a first gripping member configured to grip the first side edge portion of the opening and support the packaging bag in a suspended state, the first gripping member including a first gripping arm and first claws extending downward from the first gripping arm to grip the first side edge portion of the opening, a second gripping member configured to grip the second side edge portion of the opening and support the packaging bag in a suspended state, and a third actuator including a motor configured to move both the first gripping member and the second gripping member toward and away from one another in the first direction, the first claws include a first fixed claw and a first movable claw, and the first movable claw being configured to pivot in relation to the first fixed claw between a grip position at which the first claws grip the first side edge portion to a release position at which the first claws release the first side edge portion.

2. The bag supply system according to claim 1, wherein the bag opening device comprises a moving device configured to move the packaging bag supported in a suspended state by the first gripping member and the second gripping member from a region at or near the opening forming device to a region at or near a supply destination of the packaging bag.

3. The bag supply system according to claim 2, further comprising:

a controller configured to control the moving device and the third actuator to execute in parallel movement of the packaging bag by the moving device and movement of the first gripping member and the second gripping member by the third actuator.

4. The bag supply system according to claim 3, wherein the bag opening device comprises a fourth actuator configured to cause the first gripping member to operate to grip and release the first side edge portion, and a fifth actuator configured to cause the second gripping member to operate to grip and release the second side edge portion; and the controller controls the fourth actuator and the fifth actuator such that one gripping member of the first gripping member and the second gripping member that is located upstream in a conveyance direction of a conveyor installed at the supply destination of the packaging bag releases the edge portion first, and then an other gripping member of the first gripping member and the second gripping member that is located downstream releases the edge portion.

5. The bag supply system according to claim 1, wherein the second gripping member includes a second gripping arm and second claws extending downward from the second gripping arm to grip the second side edge portion of the opening.

6. The bag supply system according to claim 1, wherein the bag opening device comprises a fourth actuator configured to cause the first movable claw to move in relation to the first fixed claw to grip and release the first side edge portion.

7. The bag supply system according to claim 1, wherein the bag opening device comprises a fourth actuator configured to cause the first movable claw to move in relation to the first fixed claw to grip and release the first side edge portion.

8. The bag supply system according to claim 1, wherein the second gripping member includes a second gripping arm and second claws extending downward from the second gripping arm to grip the second side edge portion of the opening, the second claws include a second fixed claw and a second movable claw, and the second movable claw being configured to pivot in relation to the second fixed claw between a grip position at which the second claws grip the second side edge portion to a release position at which the second claws release the second side edge portion.

9. A bag supply method for supplying a packaging bag, comprising:

forming an opening at a bag opening of the packaging bag; and supporting each of a first side edge portion and a second side edge portion, of the opening formed, in a first direction, the first direction being a direction in which the opening is opened, and opening the bag opening by widening the opening in the first direction, wherein the first side edge portion and the second side edge portion are supported by a bag opening device that comprises a first gripping member configured to grip and support the first side edge portion of the opening, the first gripping member including a first gripping arm and first claws extending downward from the first gripping arm to grip the first side edge portion of the opening, a second gripping member configured to grip and support the second side edge portion of the opening, and a third actuator including a motor configured to move both the first gripping member and the second gripping member toward and away from one another in the first direction, the first claws include a first fixed claw and a first movable claw, and the first movable claw being configured to pivot in relation to the first fixed claw between a grip position at which the first claws grip the first side edge portion to a release position at which the first claws release the first side edge portion.

10. The bag supply method according to claim 9, wherein the bag opening device comprises a fourth actuator configured to cause the first movable claw to move in relation to the first fixed claw to grip and release the first side edge portion.

11. The bag supply method according to claim 9, wherein the second gripping member includes a second gripping arm and second claws extending downward from the second gripping arm to grip the second side edge portion of the opening, the second claws include a second fixed claw and a second movable claw, and the second movable claw being configured to pivot in relation to the second fixed claw between a grip position at which the second claws grip the second side edge portion to a release position at which the second claws release the second side edge portion.

12. The bag supply method according to claim 9, wherein the packaging bag is supported in a suspended state and moved by the first gripping member and the second gripping member from a region at or near an opening forming device used to form the opening to a region at or near a supply destination of the packaging bag.

13. The bag supply method according to claim 12, further comprising:

the bag opening device comprises a fourth actuator configured to cause the first gripping member to operate to grip and release the first side edge portion, and a fifth actuator configured to cause the second gripping member to operate to grip and release the second side edge portion; and the fourth actuator and the fifth actuator are controlled such that one gripping member of the first gripping member and the second gripping member that is located upstream in a conveyance direction of a conveyor installed at the supply destination of the packaging bag releases the edge portion first, and then an other gripping member of the first gripping member and the second gripping member that is located downstream releases the edge portion.

* * * * *